US007332991B2

(12) United States Patent
Skinner et al.

(10) Patent No.: US 7,332,991 B2
(45) Date of Patent: Feb. 19, 2008

(54) TWIN SPARK IGNITION COIL WITH PROVISIONS TO BALANCE LOAD CAPACITANCE

(75) Inventors: Albert A. Skinner, El Paso, TX (US); Harry O. Levers, El Paso, TX (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/747,541

(22) Filed: May 11, 2007

(65) Prior Publication Data

US 2007/0209645 A1 Sep. 13, 2007

Related U.S. Application Data

(63) Continuation-in-part of application No. 11/556,836, filed on Nov. 6, 2006, which is a continuation-in-part of application No. 11/041,004, filed on Jan. 24, 2005, now Pat. No. 7,148,780.

(51) Int. Cl.
*H01F 27/02* (2006.01)
*H01F 38/12* (2006.01)

(52) U.S. Cl. ..... 336/90; 336/92; 336/96; 123/635; 123/634

(58) Field of Classification Search ..... 336/90, 336/92, 96; 123/634–635
See application file for complete search history.

(56) References Cited

U.S. PATENT DOCUMENTS 4,177,782 A 12/1979 Yoshinari et al.
4,493,306 A 1/1985 Asik
5,146,905 A 9/1992 Davis
5,146,906 A 9/1992 Agatsuma
5,806,505 A 9/1998 Herbert
6,189,522 B1 * 2/2001 Moriya ..... 123/643
6,232,863 B1 5/2001 Skinner et al.
6,463,918 B1 10/2002 Moga et al.
6,474,322 B1 11/2002 Ubukata et al.
6,522,232 B2 2/2003 Paul et al.
6,556,116 B2 4/2003 Skinner et al.
6,556,118 B1 4/2003 Skinner
6,666,196 B2 12/2003 Skinner et al.
6,724,289 B2 4/2004 Moga et al.

(Continued)

FOREIGN PATENT DOCUMENTS

DE 37 30 291 A1 3/1988
DE 195 08 268 A1 9/1996
JP 2001-304081 10/2001
JP 2001-355554 12/2001

*Primary Examiner*—Anh Mai
(74) *Attorney, Agent, or Firm*—Paul L. Mitchell

(57) ABSTRACT

A twin spark ignition apparatus having two high-voltage (HV) outputs incorporates features for balancing load capacitance on each HV output. The ignition apparatus provides a first high-voltage (HV) connection configured for direct mounting on a first spark plug, and a second HV connection for coupling to a second spark plug by way of an HV cable. The HV cable adds capacitance at the second HV output, as compared to a direct mount. The secondary winding is shifted by a predetermined distance, relative to the primary winding, in direction toward the direct mount end of the ignition apparatus. The shifting reduces the internal load capacitance at the second end (top), so that when the capacitance added by the HV cable is considered, the respective load capacitances are balanced. The voltage variation between the two HV outputs is reduced.

10 Claims, 16 Drawing Sheets

U.S. PATENT DOCUMENTS

2003/0098764 A1* 5/2003 Wada ..... 336/96
2004/0231652 A1* 11/2004 Kondo et al. ..... 123/634
2006/0091987 A1 5/2006 Skinner et al.
2006/0164196 A1 7/2006 Skinner et al.

* cited by examiner

TWIN SPARK IGNITION COIL WITH PROVISIONS TO BALANCE LOAD CAPACITANCE

CROSS-REFERENCES TO RELATED APPLICATIONS

This is a continuation-in-part (CIP) application of U.S. application Ser. No. 11/556,836 filed Nov. 6, 2006, now pending, which is continuation-in-part (CIP) of U.S. application Ser. No. 11/041,004 filed Jan. 24, 2005, now U.S. Pat. No. 7,148,780, the entire disclosures of each application Ser. Nos. 11/041,004 and 11/556,836 are hereby incorporated by reference in their entireties herein.

BACKGROUND OF THE INVENTION

1. Technical Field

The present invention relates generally to an ignition apparatus or coil, and, more particularly, to a twin spark pencil coil with provisions to balance load capacitance.

2. Discussion of the Background Art

An ignition apparatus for producing a spark for ignition of an internal combustion engine has been developed in a variety of different configurations suited for the particular application desired. For example, it is known to provide an ignition apparatus that utilizes a secondary winding wound in a progressive winding pattern, specifically for "pencil" coil applications. A pencil coil is one having a relatively slender configuration adapted for mounting directly to a spark plug in a spark plug well of an internal combustion engine. A feature of a "pencil" coil is that a substantial portion of the transformer (i.e., a central core and primary and secondary windings) is located within the spark plug well itself, thereby improving space utilization in an engine compartment. In one configuration, an outer core or shield is allowed to electrically float, as seen by reference to U.S. Pat. No. 6,463,918 issued to Moga et al. entitled "IGNITION APPARATUS HAVING AN ELECTRICALLY FLOATING SHIELD."

It is also known to provide an ignition apparatus that provides a pair of high voltage outputs suitable for generating a spark to a pair of different spark plugs. In such a known product, however, the transformer portion is not mounted within the spark plug well like a pencil coil, but rather is mounted outside of and above the spark plug well and has been referred to as a plug top coil. The known plug top ignition coil employs one long boot to mate to the spark plug and includes a second tower that provides a high voltage suitable for generating a spark to another spark plug. The high voltage produced on the second tower may go to a mated cylinder undergoing an exhaust stroke (i.e., at the same time as the principal cylinder is undergoing a compression stroke—a so-called "waste" spark ignition system). Alternatively, the high voltage on the second tower may go to a second spark plug in the same cylinder. The latter arrangement may employ a center-tapped secondary winding, with a first portion of the secondary winding being wound in an opposite direction relative to a second, remaining portion of a secondary winding. This opposite winding orientation coupled with a center tap going to ground provides two negative sparks to two spark plugs which may be installed in the same cylinder. A problem with the plug top ignition coil for twin spark operation however, relates packaging. Specifically, a relatively large area above one of the two spark plug wells is needed in order to mount the plug top ignition coil. In addition, an extra bracket may be needed, which can increase cost and complexity.

It is also known to provide an ignition system providing spark for two ignition plugs in each cylinder from a single ignition coil, as seen by reference to U.S. Pat. No. 4,177,782 issued to Yoshinari et al. While Yoshinari et al. disclose an impedance circuit element, it is provided to disturb a balance of the output voltages from the secondary coil terminals.

There is therefore a need for an ignition apparatus or coil that minimizes or eliminates one or more of the problems as set forth above.

SUMMARY OF THE INVENTION

An object of the present invention is to solve one or more of the problems set forth in the Background. The present invention is provided generally to provide a structure to offset and thus balance the capacitance imbalance that might otherwise be seen between the two HV outputs of a twin spark ignition coil, arising due to the capacitance contribution of using an HV distribution mechanism (e.g., HV spark plug cable) on one of the two HV outputs. The invention balances the output voltages at the two HV outputs as well as optimizing the overall energy delivery provided by the ignition coil, by balancing the respective capacitances on each HV output connection.

The present invention includes a transformer assembly and a case. The transformer assembly includes a central core, a primary and a secondary winding, and an outer core. The central core is elongated and has a main axis. The primary and the secondary windings are disposed radially outwardly of the central core.

The case is configured to house the transformer assembly. The case includes a first high-voltage (HV) connection at a first end thereof configured for direct mounting on a first spark plug. The first HV connection has a first capacitance associated therewith when direct mounted to the first spark plug. The case further includes a second HV connection at a second end thereof opposite the first end configured for connection to a second spark plug via a high-voltage (HV) distribution mechanism. The second HV connection has a second capacitance associated therewith when coupled to the second spark plug.

The primary winding extends between a first primary winding end and an axially opposite second primary winding end. The first primary winding end is the end near the first case end (i.e., direct mount end). The secondary winding extends between a first secondary winding end and an axially opposite second secondary winding end. The first secondary winding end is the end near the first case end.

In accordance with the invention, the secondary winding is offset by a predetermined distance from the primary winding in a direction towards the first case end (i.e., direct mount end). The predetermined distance is selected such that the first capacitance and the second capacitance are balanced within a predetermined range.

Other features and advantages of the present invention are presented.

BRIEF DESCRIPTION OF THE DRAWINGS

The present invention will now be described by way of example, with reference to the accompanying drawings, in which.

DETAILED DESCRIPTION OF THE PREFERRED EMBODIMENTS

Figure 1:
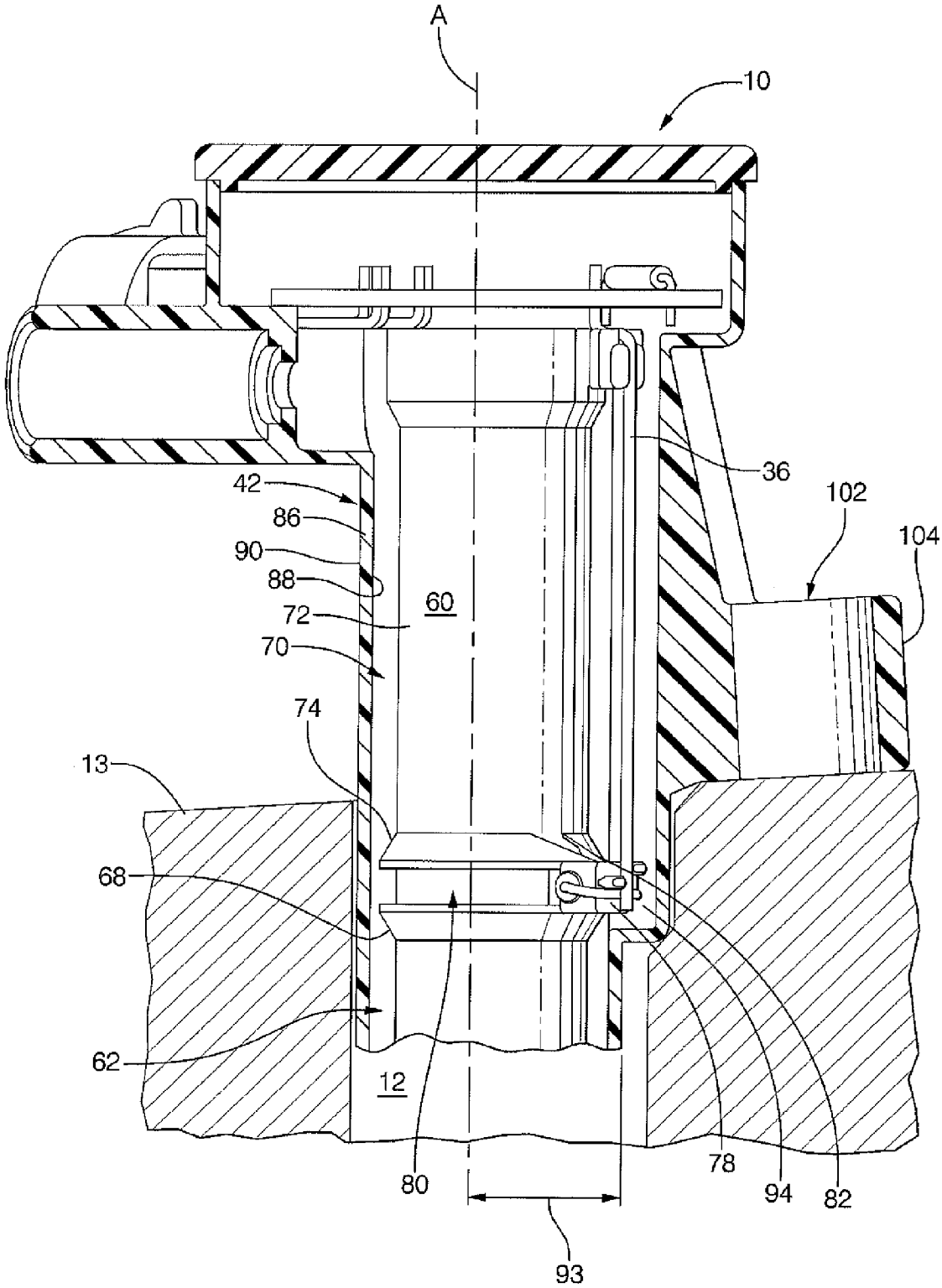
FIG. 1 is a partial, perspective view of an ignition apparatus in accordance with the present invention suitable for twin spark applications.

Referring now to the drawings wherein like reference numerals are used to identify identical components in the various views, FIG. 1 is a partial, perspective view of an ignition apparatus 10 in accordance with the present invention. Ignition apparatus 10 is configured for mounting in a spark plug well 12 in an internal combustion engine 13. Ignition apparatus 10 is configured to provide at least two high-voltage (HV) outputs with one of such HV outputs being coupled directly to a spark plug in the spark plug well 12, and the other HV output going to a second spark plug. Ignition apparatus 10 is elongated and has a main axis associated therewith, designated "A." Before proceeding to a detailed description of the various embodiments of the present invention, however, a general overview of the two basic configurations will be set forth in connection with FIGS. 2 and 3.

Figure 2:
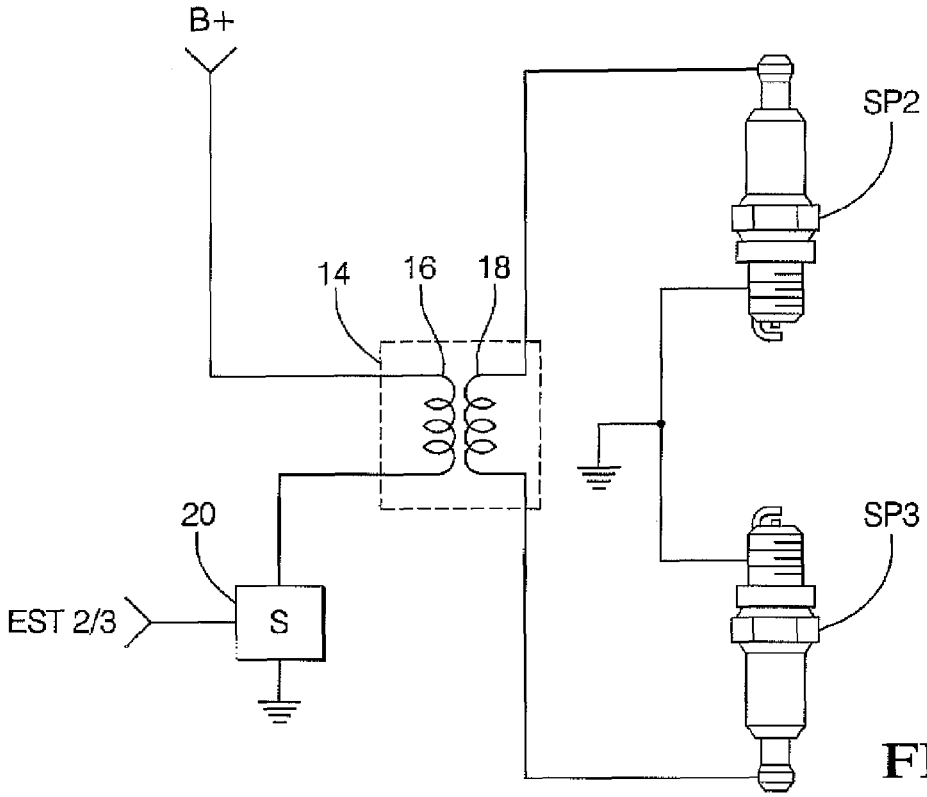
FIG. 2 is a simplified schematic and block diagram showing, in electrical form, a first embodiment of the present invention.
Figure 3:
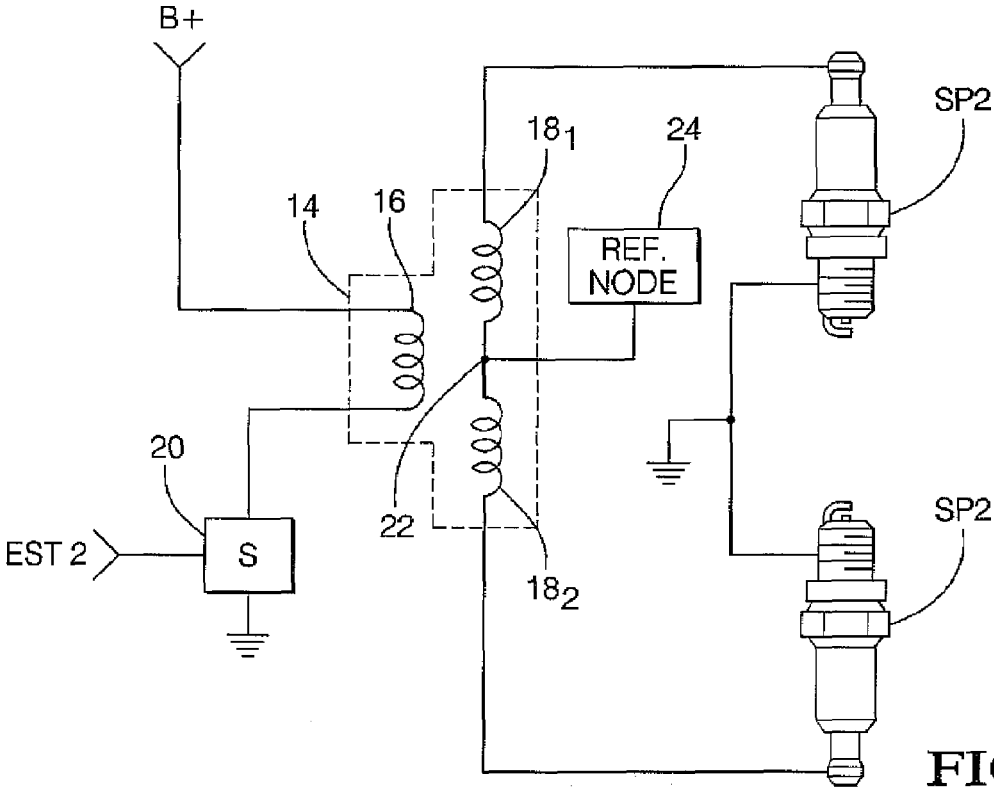
FIG. 3 is a simplified schematic and block diagram showing, in electrical form, a second embodiment of the present invention.

FIGS. 2 and 3 are simplified schematic and diagrammatic views of the basic electrical configurations of ignition apparatus 10 in two embodiments. With specific reference to FIG. 2, one configuration for ignition apparatus 10 relates to a so-called "waste" spark ignition system. FIG. 2 shows a transformer assembly 14 comprising a central, magnetically-permeable core 15 (best shown in FIG. 4), a primary winding 16, and a secondary winding 18. FIG. 2 further shows a switch 20 that is selectively opened and closed based on the state of an electronic spark timing (EST) signal. As known in the art, closing switch 20 establishes a path to ground through primary winding 16. A primary current $I_P$ is thereby established through the primary winding 16. When switch 20 is thereafter opened, the primary current $I_P$ is interrupted, causing a relatively high voltage to be produced across secondary winding 18. This high voltage across winding 18 is applied to the spark plugs, as shown.

The arrangement in FIG. 2 assumes that engine 13 has mated pairs of cylinders, for example, in FIG. 2, cylinder no. 2 and cylinder no. 3 when engine 13 is a four cylinder engine. In a "waste" spark ignition system, two sparks are generated from the high voltage produced on secondary winding 18. A first high voltage output is fed to a cylinder undergoing a compression stroke, for example, cylinder no. 2 (with a corresponding spark plug designated SP2), while a second high voltage output is provided to the mated cylinder, for example, cylinder no. 3 (with a corresponding spark plug designated SP3), which is undergoing an exhaust stroke. The two high voltage (HV) outputs from secondary winding 18, in this configuration, are of opposite electrical polarity. In the waste spark ignition system shown schematically in FIG. 2, secondary winding 18 is wound essentially as a single portion all having the same relative winding orientation. That is, the secondary winding 18 in FIG. 2 may be wound entirely in either a clockwise (CW) orientation or a counter-clockwise (CCW) orientation. The opposite polarity sparks are desired for a waste spark system but may also be used for a system with both sparks going to the same cylinder. The dual negative spark is only desired to provide the same polarity so that if long life spark plugs with premium cathode materials, such as platinum, are used the premium material only needs to be on one electrode, lowering the cost of the spark plugs. The dual negative spark cannot be used on a waste spark system because the exhaust gap breaks down significantly before the compression gap and the center tap allows current to flow through the half of the secondary going to the exhaust gap. This current effectively acts as an eddy current limiting the secondary voltage available to the compression gap to about 50% of its original value. Even when the dual negative sparks are going to the same cylinder there is some imbalance in the breakdown and burn voltages. This imbalance lowers the efficiency of the system. To minimize the effect of the imbalance on the performance of the system, the magnetic coupling between the two secondary halves should be minimized. The pencil coil magnetic configuration yields much less coupling between the two secondaries than a conventional ignition coil and therefore operates more efficiently into this imbalanced load.

A pencil coil may be characterized as having a magnetic configuration wherein the central core, the primary and secondary windings and the outer core or shield are substantially axially co-extensive along the main longitudinal axis "A." Substantially axially co-extensive means at least greater than 50% overlap between at least the central and outer cores, more preferably greater than about 90% and as shown (e.g., FIG. 7) about 100% overlap.

FIG. 3 shows an alternate configuration for ignition apparatus 10 where the secondary winding 18 includes a first portion $\mathbf{18}_1$ and a second portion $\mathbf{18}_2$. The relative winding orientation of the first and second portions $\mathbf{18}_1$ and $\mathbf{18}_2$ are opposite in nature, i.e., the first portion $\mathbf{18}_1$ is wound in one of either the CW or CCW orientations while the second portion $\mathbf{18}_2$ is wound in the opposite orientation (i.e., the other one of the CW or CCW orientations). A center tap node 22 is provided to establish a center-tapped secondary winding, and is coupled to a reference node 24, which may be either a reference ground node or a battery voltage, designated B+ in the drawings. The configuration of FIG. 3 produces two negative sparks, which may be provided to two spark plugs in the same cylinder, as shown in FIG. 3 (i.e., provided to two spark plugs, each designated SP2 for cylinder no. 2).

Figure 4:
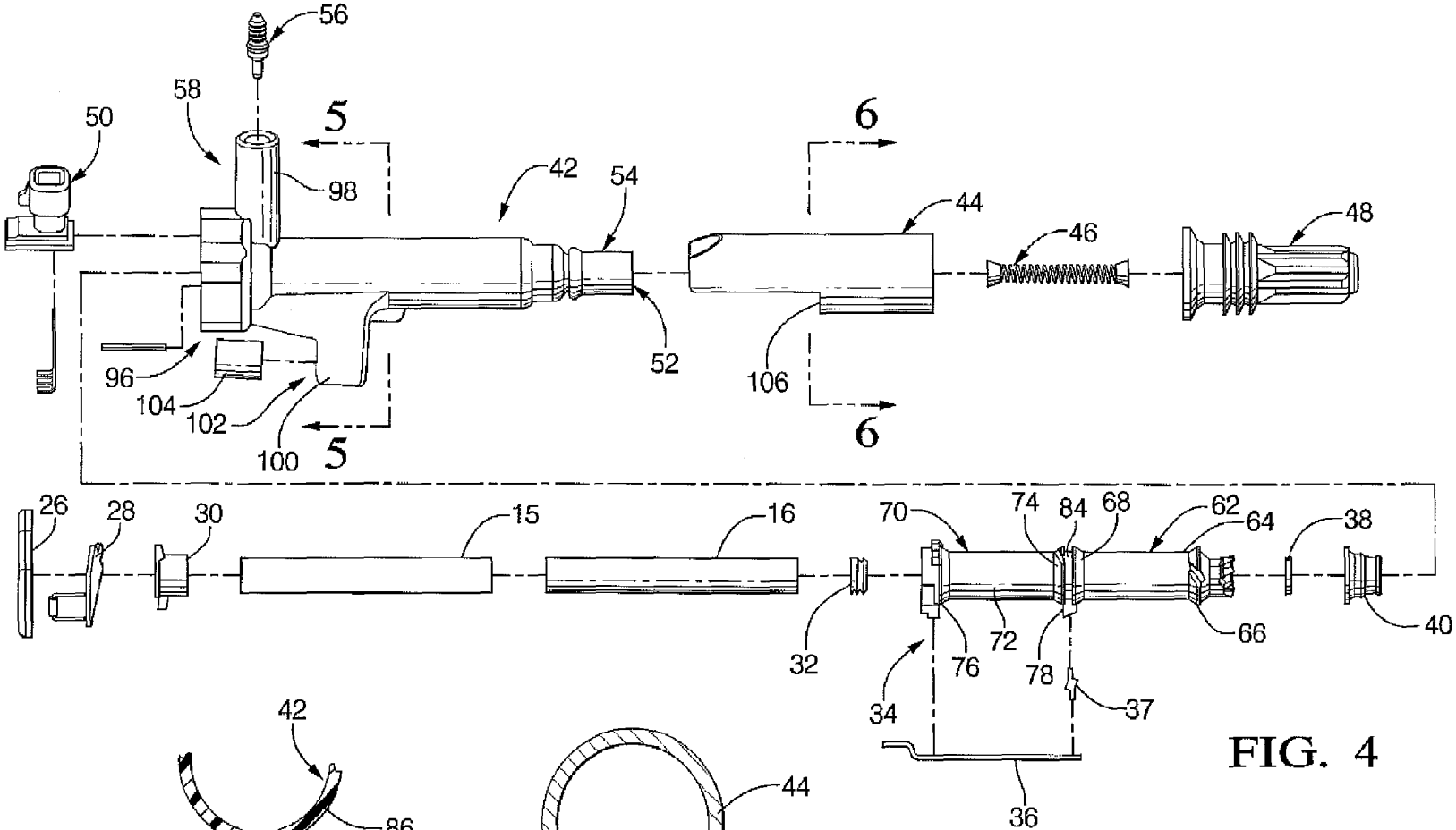
FIG. 4 is a perspective, exploded diagram view of an ignition apparatus in accordance with the present invention.

FIG. 4 is an exploded, perspective view of the subcomponents of ignition apparatus 10. FIG. 4 shows a cover 26, a mechanism such as a circuit board 28 for terminating a center tap conductor, a cap 30, central core 15, primary winding 16, a buffer cup 32, a secondary spool 34, a center tap conductor 36, an optional HV diode 37, a high-voltage terminal 38, a high-voltage cup 40, a case 42, a shield 44, a spring 46, a combination boot/seal 48 and a system connector 50.

Ignition apparatus 10 may be coupled to an ignition system (not shown), via system connector 50, which may control the primary energization circuitry to control the charging and discharging of ignition apparatus 10. Further, as shown schematically in FIGS. 2 and 3, the relatively high voltage(s) produced by ignition apparatus 10 is provided to two or more spark plugs for producing sparks across respective spark gaps thereof, which may be employed to initiate combustion in a combustion chamber of the internal combustion engine 13.

With continued reference to FIG. 4, ignition apparatus 10 is configured to produce at least two high voltage outputs, such as at a first high voltage (HV) connection 52 at a first end 54 and at a second HV connection 56 at a second end 58 of ignition apparatus 10. Second end 58 is axially opposite the first end 54.

Ignition apparatus 10 is packaged as a so-called "pencil" coil where at least a portion of the transformer assembly 14 is designed to fit inside a cylinder of less than 30 mm in diameter such as spark plug well 12. This is best shown in FIG. 1. This arrangement is in contrast to the plug top coil known in the art in which the transformer is located outside of the spark plug well. Ignition apparatus 10 is thus adapted for installation to a conventional internal combustion engine directly onto a high-voltage terminal of a spark plug via the first HV connection 52 (best shown in FIG. 4). As known, such spark plug may be retained by a threaded engagement with a spark plug opening of an engine head. The second HV connection 56 is proximate or near a second HV tower, and which provides a high voltage to another spark plug. Ignition apparatus 10 comprises in-effect a substantially slender high voltage transformer assembly including substantially, coaxially arranged primary and secondary windings and a high permeability magnetic central core 15.

With continued reference to FIG. 4, central core 15 may be elongated, and have a main longitudinal axis (e.g., coincident with main axis "A" of ignition apparatus 10 shown in FIG. 1). Core 15 may be a conventional core known to those of ordinary skill in the art. Core 15 may therefore comprise magnetically permeable material, for example, a plurality of silicon steel laminations, or, insulated iron particles compression molded to a desired shape. In the illustrated embodiment, core 15 may take a generally cylindrical shape, which defines a generally circular shape in radial cross-section.

Primary winding 16 may be wound directly onto central core 15 or may be wound onto a primary winding spool (not shown). Primary winding 16 includes first and second ends and is configured to carry a primary current $I_P$ for charging ignition coil 10 based upon the control established by an ignition system (not shown). Primary winding 16 may be implemented using known approaches and conventional materials.

The primary and secondary windings 16, 18 may both be disposed radially outwardly of central core 15, and, in the illustrated embodiment, the secondary winding 18 is wound on secondary spool 34 that is radially, outwardly of the primary windings 16 (i.e., secondary outside of primary).

Secondary winding spool 34 is configured to receive and retain secondary winding 18. Spool 34 is disposed adjacent to and radially outwardly of the central components comprising core 15 and primary winding 16, and may be in coaxial relationship therewith. Secondary winding 18 is preferably wound in a progressive wound pattern.

Secondary spool 34 includes a generally cylindrical body 60 (best shown in FIG. 1), having a first winding bay 62 defined by a first, annular winding surface 64 that is bounded by a first pair of retaining flanges 66, 68. Secondary spool 34 further includes a second winding bay 70 defined by a second, annular winding surface 72 that is bounded by a second pair of retaining flanges 74, 76. Retaining flanges 66, 68 and 74, 76 may be tapered, as taken with respect to the main longitudinal axis of the spool, as illustrated by reference to U.S. Pat. No. 6,232,863 to Skinner et al. entitled "SPOOL ASSEMBLY FOR AN IGNITION COIL," herein incorporated by reference in its entirety. Spool 34 further includes a center tap feature 78 extending from the cylindrical body 60.

Referring now to FIG. 1, secondary spool 34 further includes an axially-central region 80 in which retaining flanges 68 and 74 are disposed. Secondary spool 34 may be further configured with first and second lead-in grooves 82 and 84 (best shown in FIG. 4) that lead into the second winding bay 70. The lead-in grooves 82, 84 are respectively configured to allow winding in the second bay 70 to be either in the same or in the opposite orientations relative to the winding in the first winding bay, consistent with the two embodiments depicted in FIGS. 2 and 3. Accordingly, in one embodiment where ignition apparatus 10 is used in a waste spark ignition system, one of the lead-in grooves 82, 84 is used to allow a first portion $\mathbf{18}_1$ of the secondary winding that is in the first winding bay 62 to be continued into the second winding bay 70 to form the second portion $\mathbf{18}_2$. The first portion $\mathbf{18}_1$ and the second portion $\mathbf{18}_2$ in this arrangement are both wound in either the clockwise (CW) orientation or the counter-clockwise (CCW) orientation. This embodiment corresponds to the schematic shown in FIG. 2.

In an alternate embodiment, assuming that the first portion $\mathbf{18}_1$ of the secondary winding that is located in the first winding bay 62 is wound in one of a clockwise or counter-clockwise orientations, the other one of the lead-in grooves 82, 84 is configured to allow the second portion $\mathbf{18}_2$ to be wound in the opposite orientation, namely, the other one of the CW or CCW orientation in the second winding bay. This groove allows both ends of the first and second portions $\mathbf{18}_1$ and $\mathbf{18}_2$ of the secondary winding to enter into the central region 80, to be coupled together at a center tap node near the center tap feature 78. This arrangement may involve termination of the winding ends either to (i) a center-tap conductor 36 or (ii) to an HV diode 37 (i.e., the HV diode 37 then terminating to the center-tap conductor, as known, as seen generally by reference to U.S. Pat. No. 6,666,196 issued to Skinner et al. entitled "IGNITION SYSTEM HAVING IMPROVED SPARK-ON-MAKE BLOCKING DIODE IMPLEMENTATION" herein incorporated by reference). The center-tap arrangement corresponds to the schematic of FIG. 3.

Secondary spool 34 is formed generally of electrical insulating material having properties suitable for use in a relatively high temperature environment. For example, spool 34 may comprise plastic material such as polybutylene terephthalate (PBT) thermoplastic polyester. It should be understood that there are a variety of alternative materials which may be used for spool 34 known to those of ordinary skill in the ignition art, the foregoing being exemplary only and not limiting in nature.

With reference to FIG. 1, case 42 is configured to house transformer assembly 14 such that at least a portion of the transformer assembly 12 is disposed within spark plug well 12. Case 42 includes an axially-extending, generally annular body portion 86 in which the transformer assembly 12 is housed. The annular body portion 86 includes an inside surface 88 and an outside surface 90. The center tap node 22 (best shown schematically in FIG. 3) is formed by the ends of the secondary winding 18 that extend into the central region 80 of the secondary spool 42. In the illustrated embodiment, the center tap conductor 36 is axially-extending and radially offset from the main axis "A" by an amount designated by reference numeral 93. Case 42 still further includes a trough 94 disposed radially outwardly of the annular body portion 86 defining a channel through which the center tap conductor 36 extends.

With further reference to FIGS. 1 and 4, in the embodiment of the invention that is configured to provide a dual negative output for two spark plugs in the same cylinder (e.g., corresponding to the schematic of FIG. 3), the center tap conductor 36 is routed to the top of the ignition apparatus 10 in and through trough 94 for termination at circuit board 28. This termination may then be coupled electrically to ground or battery, as shown schematically in FIG. 3. Conductor 36 is located substantially in the shield gap. A description of this location will be elaborated upon below.

Figure 5:
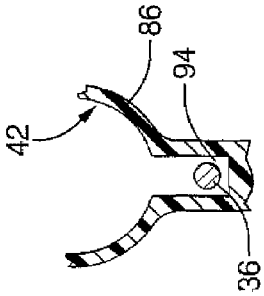
FIG. 5 is a partial, cross-sectional view of a trough portion of a case taken substantially along lines 5-5 in FIG. 4.

FIG. 5 is a partial, cross-sectional view of trough 94 taken substantially along lines 5-5 of FIG. 4. FIG. 5 shows the center tap conductor 36 extending through the trough 94 that is located radially outwardly of the annular body portion 86. It should be understood that the shield 44 and the center tap conductor 36 are nearly the same voltage relative to the high voltage associated with the secondary winding. As described above, the reference node 24, to which the center tap conductor 36 is attached, is typically ground or battery voltage B+ depending upon the termination approach. Maintaining the center tap conductor 36 in the trough 94 restrains the conductor 36 from falling below the inside diameter (I.D.) of the shield 44 so as to significantly reduce the electric field concentration set by the center tap conductor as it passes to the high voltage end of the secondary winding near the top of the ignition apparatus 10 (i.e., near top end 58).

With further reference to FIG. 4, shield 44 is generally annular in shape and is disposed radially outwardly of case 42 and, preferably, engages an outer surface 90 of case 42. Shield 44 preferably comprises electrically conductive material, and more preferably, metal, such as silicon steel or other adequate magnetic material. Shield 44 may include one or more cylindrical layers of silicon steel totaling a desired thickness. Shield 44 among other things may function as an outer magnetic "core" and provide a magnetic path for the magnetic circuit portion of ignition apparatus 10. Shield 44 may be electrically grounded.

Further, in the illustrated embodiment, shield 44 includes a notch 106. Notch 106 is configured to allow the center tap conductor 36 to extend through trough 94 to circuit board 28. Otherwise, the presence of shield 44 in that region would physically conflict with the presence of the center tap conductor 36.

Figure 6:
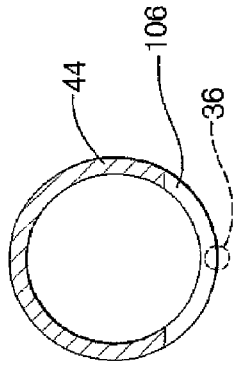
FIG. 6 is a partial, cross-sectional view showing a notch feature in a shield taken substantially along lines 6-6 in FIG. 4.

FIG. 6 is a partial cross-sectional view taken substantially along lines 6-6 in FIG. 4. FIG. 6 shows how trough 94 maintains the center tap conductor 36 (shown in phantom line) outwardly of the inside diameter (ID) of the shield 44. As described above, this location for conductor 36 is effective to reduce an electric field concentration around the conductor 36. This reduced electric field concentration has the positive effect of reducing or minimizing degradation of the case materials in ignition apparatus 10.

With continued reference to FIG. 4, case 42 further includes a connector body 96 that has an HV tower 98. The HV tower 98 provides the structure to allow the high voltage generated on second HV connection 56 to be provided to a second spark plug. Connector body 96 includes a central space in which circuit board 28 can be disposed. As described above, circuit board 28 provides a mechanism for termination of the center tap conductor 36. This electrical termination is best shown in FIG. 1.

Case 42 further includes system connector 50, which includes conductive terminals arranged for connection to a mating terminal (not shown) for communication of power and control signals between the ignition apparatus 10 and an ignition system controller or other master controller (not shown).

Case 42 may optionally further includes a mounting flange 100 containing a through bore 102 adapted in size and shape to receive a bushing 104. Mounting flange 100 provides a mechanism to allow the optional connection of ignition apparatus 10 to engine 13 or other portion of the engine compartment. Note, the ignition apparatus 10 may be relatively rigidly coupled via the direct connection of first HV output 52 to a spark plug in the spark plug well 12.

Inner surface 88 or inside diameter (ID) of case 42 is configured in size to receive and retain the assembly comprising core 15/primary winding 16/secondary spool 34/secondary winding 18. The inner surface 88 may be slightly spaced from spool 34, for example through the use of annular spacing features or the like, or may in fact engage the secondary spool 34. Case 42 may be formed of electrical insulating material, and may comprise conventional materials known to those of ordinary skill in the art (e.g., the PBT thermoplastic polyester material referred to above).

Still referring to FIG. 4, HV terminal 38, HV cup 40, and spring 46 define an HV connector assembly configured to engage a high-voltage connector terminal of a spark plug, as seen by reference to U.S. Pat. No. 6,522,232 B2 issued to Paul et al. entitled "IGNITION APPARATUS HAVING REDUCED ELECTRIC FIELD HV TERMINAL ARRANGEMENT," herein incorporated by reference in its entirety. This arrangement for coupling the high voltage developed by secondary winding 18 is exemplary only; a number of alternative connector arrangements, particularly spring-biased arrangements, are known in the art.

Boot and seal assembly 48 may comprise silicone material or other compliant, electrically insulative material, as known in the art. Assembly 48 may comprise conventional materials and construction known in the art.

In an alternate embodiment, the centerline of the transformer assembly 14 may be offset from the centerline of the HV connector/boot 48, for improved packaging.

The embodiment described above utilizes a progressive secondary winding pattern for twin spark applications. In the twin spark arrangement, ignition coil 10 mounts directly to one spark plug, with a second tower (i.e., tower 98) providing a high voltage to another spark plug. The second tower may go to a mated cylinder operating on the exhaust stroke or to a spark plug in the same cylinder operating in compression. These ignition coils may also have a center-tapped secondary winding with portions of the winding being wound in opposite directions to provide two negative sparks to two spark plugs in the same cylinder. To control and maintain a relatively small diameter, the ignition apparatus 10 described above provides that at least a part of the transformer assembly 14 is located within the spark plug well 12. In that embodiment, shield 44 is external to case 42.

Figure 7:
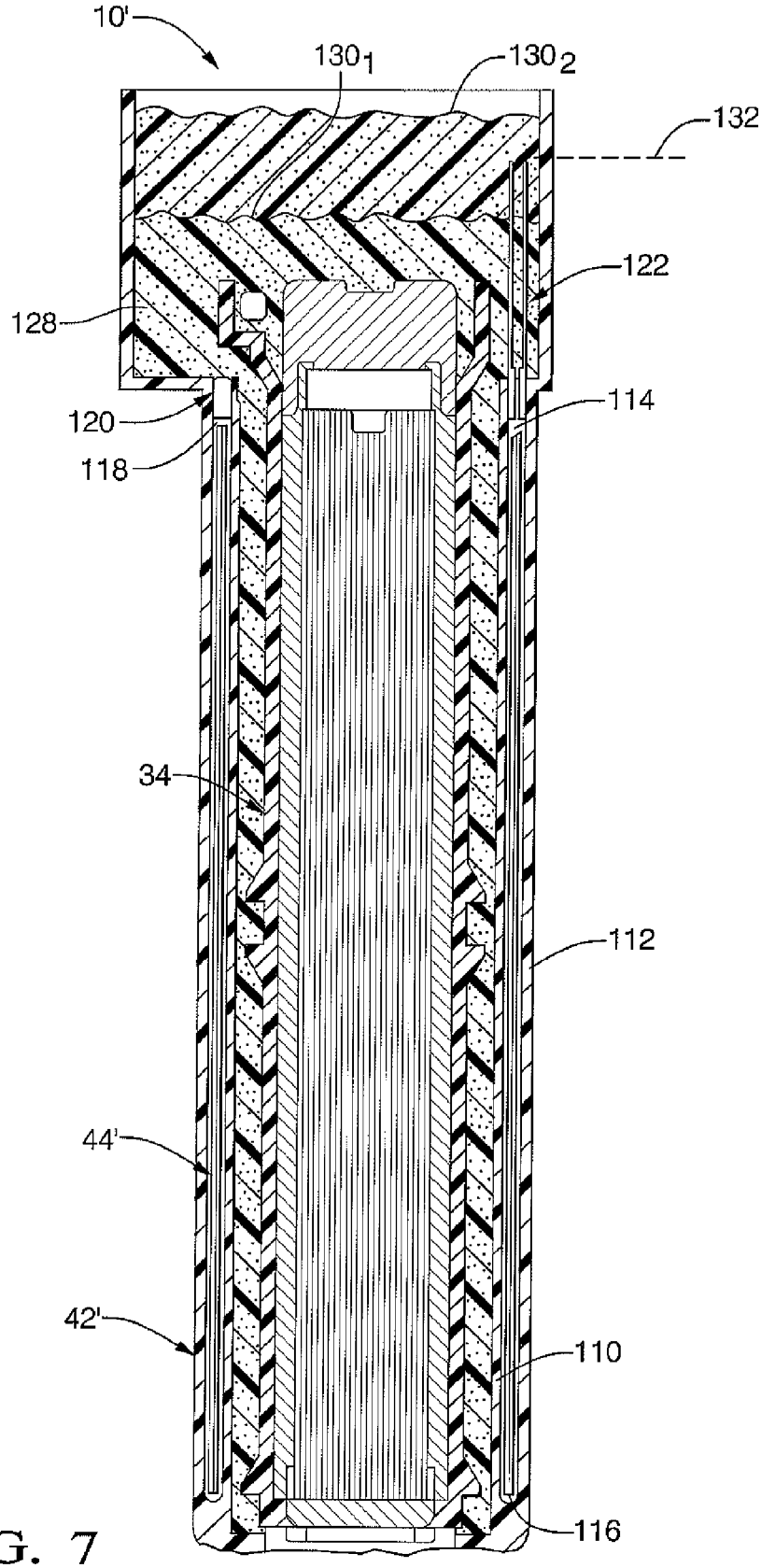
FIG. 7 is a simplified cross-sectional view of an ignition apparatus in accordance with a second aspect of the present invention having an isolated, internal floating shield.
Figure 8:
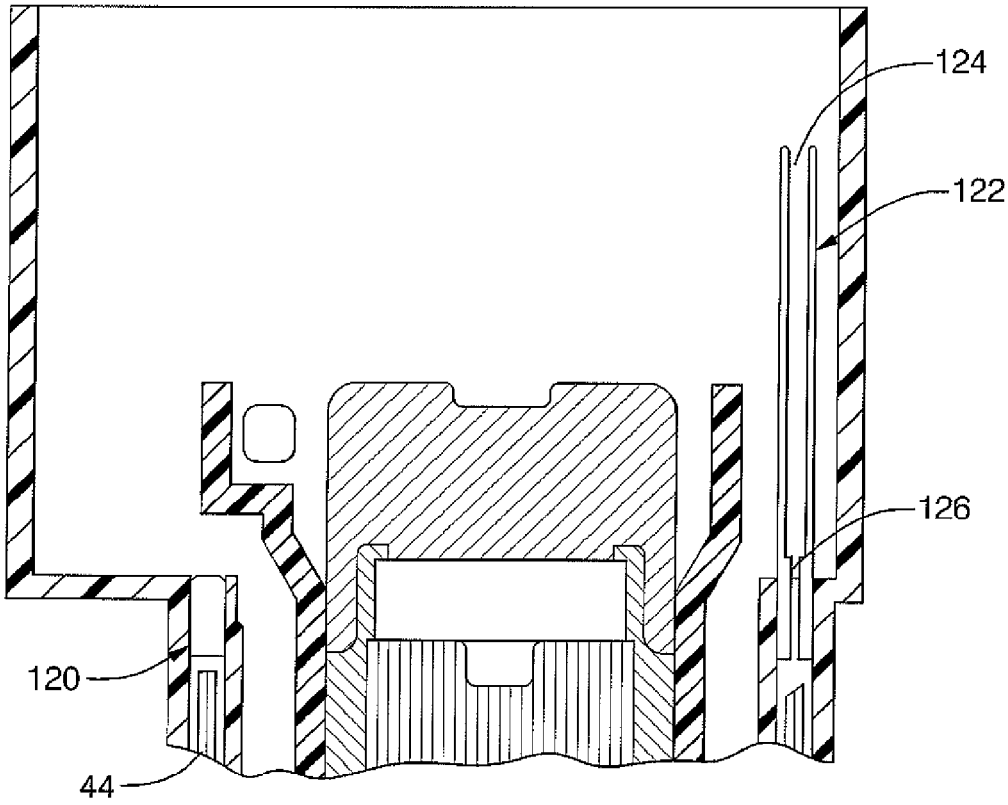
FIG. 8 is a simplified, enlarged view of a portion of FIG. 7 showing a seal in greater detail.
Figure 9:
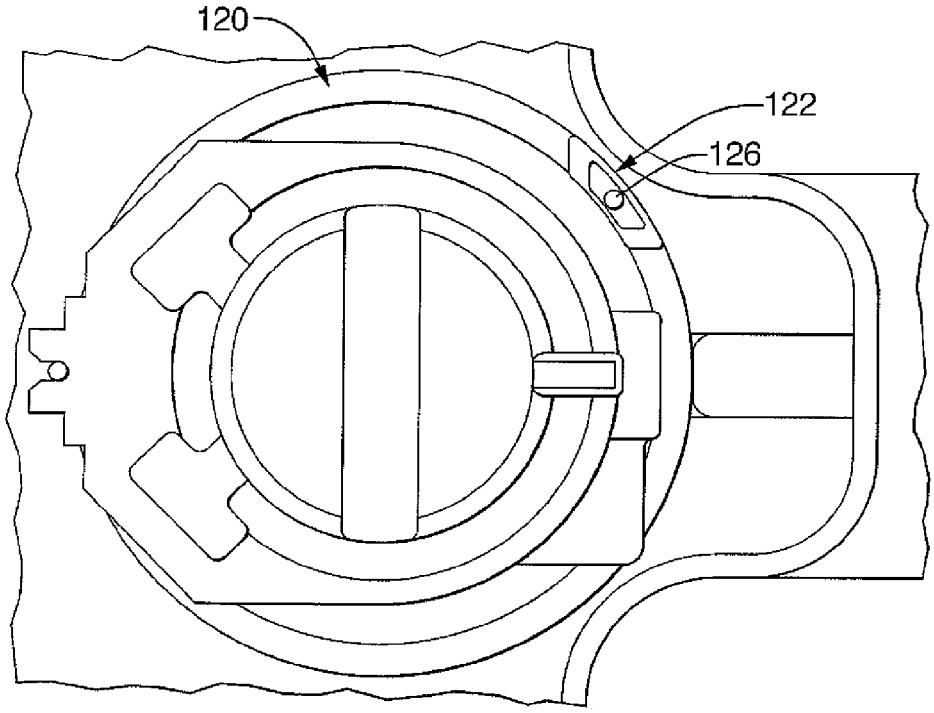
FIG. 9 is a top, plan view of the seal of FIG. 8.

Referring now to FIGS. 7-9, in accordance with another aspect of the present invention, an alternative embodiment, designated ignition apparatus 10', is provided that includes an isolated internal shield 44'.

Ignition apparatus 10' achieves the foregoing by providing a case 42' that includes an inner, annular wall 110, and an outer, annular wall 112 that is spaced radially outwardly from inner wall 110 so as to define a shield chamber 114 therebetween. The shield chamber 114 is closed at the bottom (i.e., at end 54), the closed end being designated by reference numeral 116. The shield chamber 114 further includes an opening 118 at the top or second end 58. The opening is annular in shape. Shield chamber 114 is configured in size and shape to receive or accept a shield 44'. The opening 118, being at the top of ignition apparatus 10', is towards the potting surface during potting operations (described below). Shield chamber 114 may be formed by molding case 42' as a unitary part having the chamber, as shown in FIG. 7, or it may be formed by press fitting a tube into the case to form the chamber 114 (i.e., the tube would have a smaller diameter than the inside diameter of the case such that when inserted, the chamber 114 would be formed). Shield 44' is then assembled into shield chamber 114 through opening 118.

Ignition apparatus 10' further includes an annular seal or cover 120 that is configured in size and shape to be press-fit into opening 118 to seal opening 118, preventing epoxy potting material 128 or other encapsulant from entering into the shield chamber 114. A novel feature of annular seal 120 is that it includes a snorkel 122 extending axially away from the remainder of the seal. Specifically, snorkel 122 extends axially from the shield chamber 114 to a level 132 above the epoxy surface at the time vacuum is broken, such level being designated by reference numeral $\mathbf{130}_1$.

As best shown in FIG. 8, snorkel 122 is configured to include a through-passage or bore 124 having a restriction 126. The restriction is configured to allow communication of air but not to allow communication of epoxy potting material or other encapsulant.

After epoxy 128 has been introduced to fill the case 42' to a level above the primary and secondary windings (e.g., level $\mathbf{130}_1$), the vacuum is removed and the potting chamber pressure is raised to atmospheric pressure. The snorkel 122 is configured to have an upper extent that is above the potting level at this time. This extended height or level 132 of the snorkel is higher than the first potting level $\mathbf{130}_1$.

When the pressure is raised (e.g., from a vacuum level upwards towards atmosphere), the pressure inside the shield chamber 114 also is allowed to go to atmosphere and accordingly there exists little or no pressure differential to drive epoxy 128 into the shield chamber 114. After the shield chamber 114 has reached atmospheric pressure, additional epoxy material 128 is added to top off the ignition apparatus 10'. For example, additional epoxy potting material may be added to reach a second level, designated $\mathbf{130}_2$ (best shown in FIG. 7). The epoxy potting material 128 thus covers the top of snorkel 122 to seal the chamber 114 from outside material and influences. Restriction 126 in the snorkel air path 124 is configured to allow air to pass but not epoxy potting material 128. The axial length of shield 44' is configured such that under thermal expansion of the case, shield 44' never touches the top or bottom of the shield chamber 114 at the same time, so therefore little or no mechanical stresses are applied from shield 44' to case 42'.

Shield 44', in the embodiment shown in FIGS. 7-9, may be allowed to electrically float between the secondary voltage and the external ground voltage. This electrical arrangement reduces the magnitude of the electric field across the walls of the shield chamber 114 (e.g., case), thereby allowing for thinner walls, and reducing the overall diameter with respect to the embodiment of FIGS. 1-6. A more specific description of the advantages of a floating shield may be seen by reference to U.S. Pat. No. 6,463,918 issued to Moga et al. entitled "IGNITION APPARATUS HAVING AN ELECTRICALLY FLOATING SHIELD," herein incorporated by reference.

FIG. 9 is a top plan view of seal 120, and shows the top opening of air passage 124.

In a yet further alternative embodiment, snorkel 122 is allowed to remain above the epoxy potting level through the cure phase, after which the case is closed through the use of cover 26.

FIGS. 10-19 depict additional illustrative embodiments of the present invention. The ignition coil 10 of the first embodiment utilizes a progressive winding for a "pencil" coil twin spark application. In that embodiment, the coil 10 has a first HV connection that mounts directly to a one spark plug while a second HV connection provides a spark voltage to another spark plug. The second HV connection may be coupled to (i) a mated cylinder on the exhaust stroke (i.e., while the first HV connection goes to the cylinder in compression) or (ii) to another plug in the same cylinder in compression. This ignition coil arrangement may be provided with a center-tapped secondary winding wherein the two portions formed are wound in opposite orientations to provide two negative sparks to two spark plugs in the same cylinder. However, a characteristic of this embodiment is that such a configuration limits the output of the second HV connection after the breakdown of the first HV connection. If the spark gaps coupled to both first and second HV connections do break down then the overall energy is reduced because the majority of the current flows into the gap with the lowest burn voltage and therefore the lowest efficiency. The desired ignition coil configuration for a two plug system is the non center-tapped secondary winding that provides one positive and one negative spark voltage.

To the extent that the capacitive load is balanced with respect to the two HV outputs, then each such HV output receives equivalent available voltage. One challenge arises, however, if one HV output has a lower (or greater) load capacitance. This imbalance may exist, for example, due to the fact that such an ignition coil is directly mounted to a first spark plug but is connected to the second spark plug by a HV connection mechanism such as an HV cable, which inserts its own load capacitance. This imbalance not only increases the output HV voltage (i.e., measured in kV) to the lower capacitance HV connection but it also decreases the voltage output to the HV connection with the higher capacitance.

Figure 10:
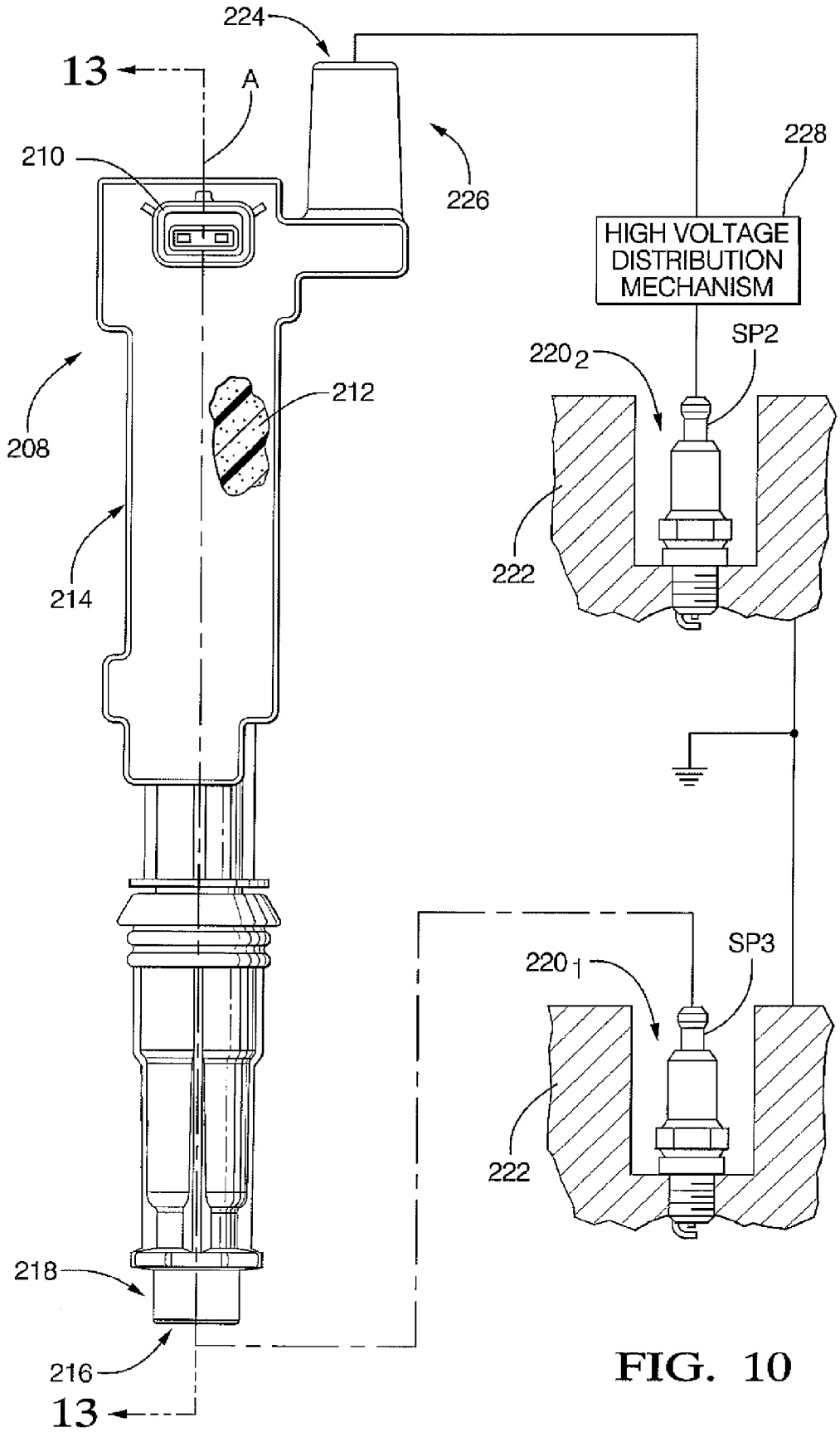
FIG. 10 is a side view of an ignition apparatus in accordance with a capacitance balancing aspect of the invention.

FIG. 10 illustrates an ignition apparatus 208. The description above of the first embodiment 10 applies equally to apparatus 208, except as to differences as described below. Ignition apparatus 208 is configured to be controlled by a control signal (e.g., an electronic spark timing (EST) signal) received through a low voltage (LV) connector assembly 210. Ignition apparatus 208 includes a pencil coil transformer assembly 212 and a case 214.

Case 214 extends along a main axis designated "A" in FIG. 10, and is configured to house transformer assembly 212. Case 214 includes a first high-voltage (HV) connection 216 proximate or near a first longitudinal end 218. First HV connection 216 is configured for direct mounting on a first spark plug, which is designated SP3 in FIG. 10. First spark plug SP3 may be disposed in a first spark plug well $\mathbf{220}_1$ formed in an internal combustion engine 222. The first HV connection 216 has a first capacitance $C_1$ associated therewith when directly mounted to the first spark plug ("SP3").

Case 214 further includes a second high-voltage (HV) connection 224 proximate a second longitudinal end 226. Second end 226 is axially opposite first end 218 in the illustrative embodiment. Second HV connection 224 is configured for connection to a second spark plug (designated SP2 in FIG. 10) via a high-voltage (HV) distribution mechanism 228. Second spark plug SP2 may be disposed in a second spark plug well $\mathbf{220}_2$ formed in internal combustion engine 222. The HV distribution mechanism 228 may be a conventional HV spark plug lead or cable 228. The second HV connection 224 has a second capacitance $C_2$ associated therewith when connected to the second spark plug.

Figure 11:
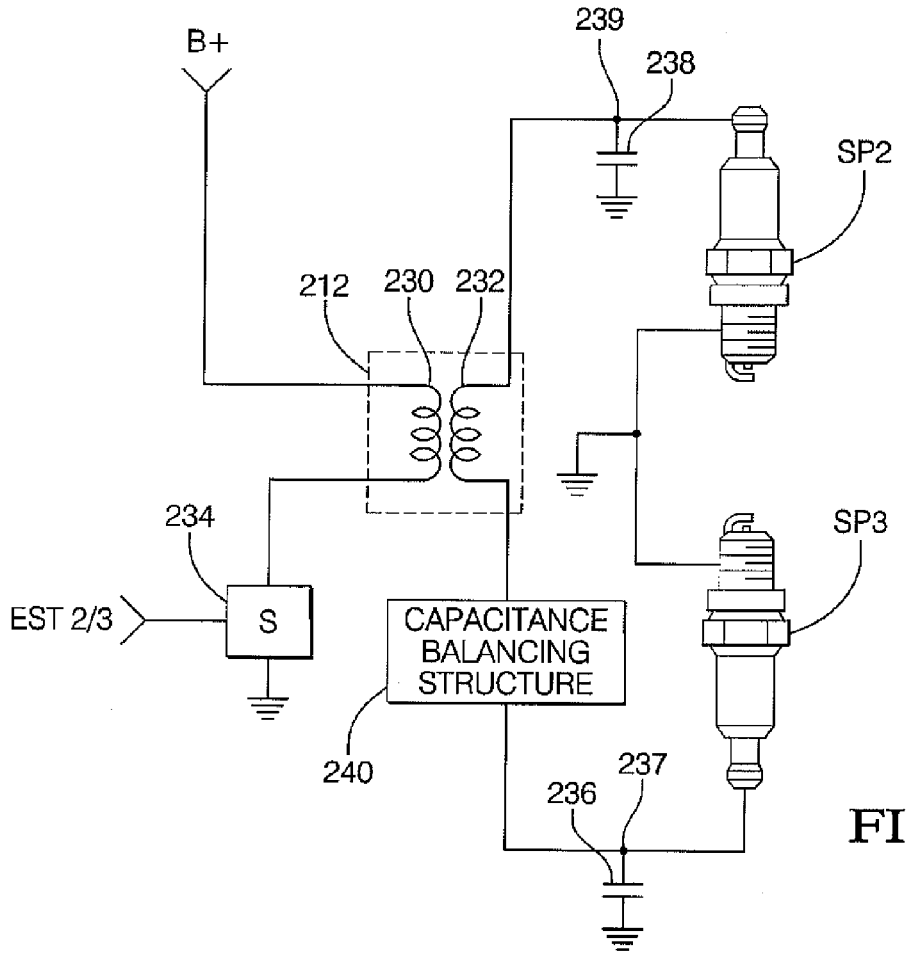
FIG. 11 is a schematic diagram corresponding to the embodiment of FIG. 10.

FIG. 11 is a schematic and block diagram of the ignition apparatus 208 shown in FIG. 10. As illustrated, transformer assembly 212 includes a primary winding 230 and a secondary winding 232. A charging current is controlled by a switch 234 in accordance with an electronic timing signal, all as described above in connection with apparatus 10 and FIG. 2. The first HV connection 216 is directly mounted to the first spark plug SP3 and has a capacitance 236 associated therewith (i.e., corresponding to the first capacitance $C_1$ described above). The second HV connection 224 is connected to the second spark plug SP2, and has a capacitance 238 associated therewith (i.e., corresponding to the second capacitance $C_2$ described above). In accordance with the present invention, a capacitance balancing structure 240 is disposed in the ignition apparatus 208 and arranged such that the first capacitance 236 and the second capacitance 238 are balanced, one to another, within a predetermined range. Under the conditions of the first and second capacitance 236, 238 being balanced to within a predetermined range, the output voltages at the respective spark plugs can be likewise controlled to within a specified range, and the optimal (maximum) amount of energy delivered for ignition.

With continued reference to FIG. 11, the first capacitance 236 ($C_1$) is governed by the following equation (1):

$$C_1 = C_{S1} + C_{L1} \tag{1}$$

Where $C_{S1}$ is the capacitance associated with the secondary winding 232, specifically, approximately ½ of the secondary winding capacitance taken with respect to a voltage reference such as ground; and $C_{L1}$ is the capacitance associated with the load, as observed from node 237.

Additionally, the second capacitance 238 ($C_2$) is governed by equation (2):

$$C_2 = C_{S2} + C_{L2} \tag{2}$$

Where $C_{S2}$ is the capacitance associated with the secondary winding 232, specifically, approximately ½ the secondary winding capacitance taken with respect to a voltage reference such as ground; and $C_{L2}$ is the capacitance associated with the load, as observed from node 239.

Note that the load capacitance $C_{L2}$ would include the capacitance of the HV spark plug cable 228. The respective voltages developed at node 237 (referred to as $V_1$ in the equation below) and at node 239 (referred to as $V_2$ in the equation below) are set forth in equations (3) and (4) below:

$$V_1 = \sqrt{\frac{2E_a}{\left(C_1 + \frac{C_1^2}{C_2}\right)}} \tag{3}$$

$$V_2 = \sqrt{\frac{2\left(E_a - \frac{1}{2}C_1V_1^2\right)}{C_2}} \tag{4}$$

Where $E_a$ is the energy available to the secondary winding 232;

$V_1$ is the voltage developed at node 237;

$V_2$ is the voltage developed at node 239;

$C_1$ is the capacitance at node 237; and $C_2$ is the capacitance at node 238.

For maximum voltages, the first and second capacitances $C_1$ and $C_2$ should be balanced (i.e., $C_1 = C_2$). However, in the absence of the present invention, $C_1$ will be lower than $C_2$ by virtue of the capacitance added by HV cable 228. If $C_{S1} = C_{S2}$ (i.e., assuming that the secondary winding capacitances would not be altered and are thus are approximately the same), then to reduce or lower $C_{L1}$ (to obtain balance) not only increases $V_1$ but decreases $V_2$ as well (per equations (3) and (4)). It is therefore preferred to increase $C_{S1}$ in order to balance the capacitances $C_1$ and $C_2$.

Accordingly, this aspect of the present invention provides an ignition apparatus with a capacitance balancing structure 240 configured to offset what might otherwise exist as an imbalance in capacitance attributable to the HV distribution mechanism 238.

Figure 12:
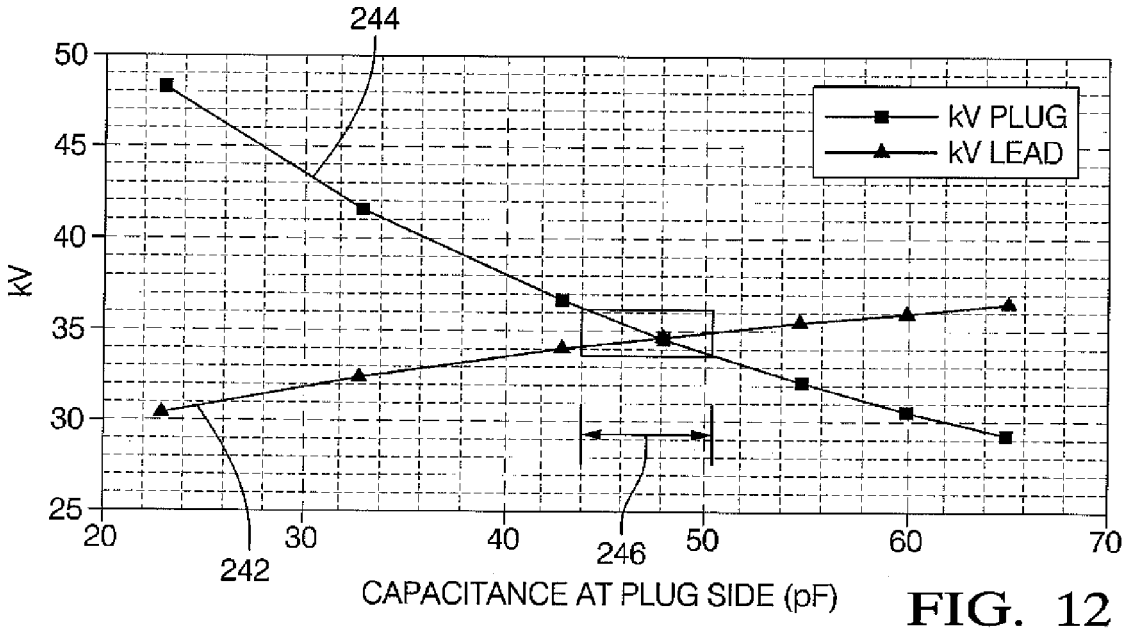
FIG. 12 is simplified chart showing output voltage versus capacitance for the two high-voltage (HV) connections shown in FIG. 11.

FIG. 12 is chart of the voltages at the two HV towers (i.e., HV outputs) as a function of capacitance. Trace 242 reflects voltage-versus-capacitance for the HV connection via the HV cable or lead to plug SP2. Trace 244 reflects voltage-versus-capacitance for the HV connection directly mounted to plug SP3.

As an example, when the first HV connection 216 of the ignition coil is directly mounted to the first spark plug SP3, then the load capacitance at this end may be between about 15 and 25 pF. When the second HV connection 224 of the ignition apparatus is connected to the second spark plug SP2 via an HV cable 228 or the like, then the load capacitance at that end may be between about 25 and 50 pF (due to the additional capacitance attributable to the HV cable). In the graph of FIG. 12, the voltage at the second HV connection 224 (i.e., the end coupled to an HV cable 228) intersects that of the first HV connection 216 at approximately 48 pF. The graph further shows that to maintain both of the output voltages to within a predetermined range of +/−1 kV, the capacitance should preferably be balanced to within a predetermined range, shown as between about −4 pF to +2.2 pF, taken with respect to a 48 pF capacitance. It should be understood that an even greater reduction in variation between the two HV output voltages will require a corresponding reduced predetermined range for balancing the first and second capacitances, likewise, enlarging the permitted variation in the HV outputs, would admit of an enlarged predetermined range for the variation in the balanced capacitances.

Figure 13:
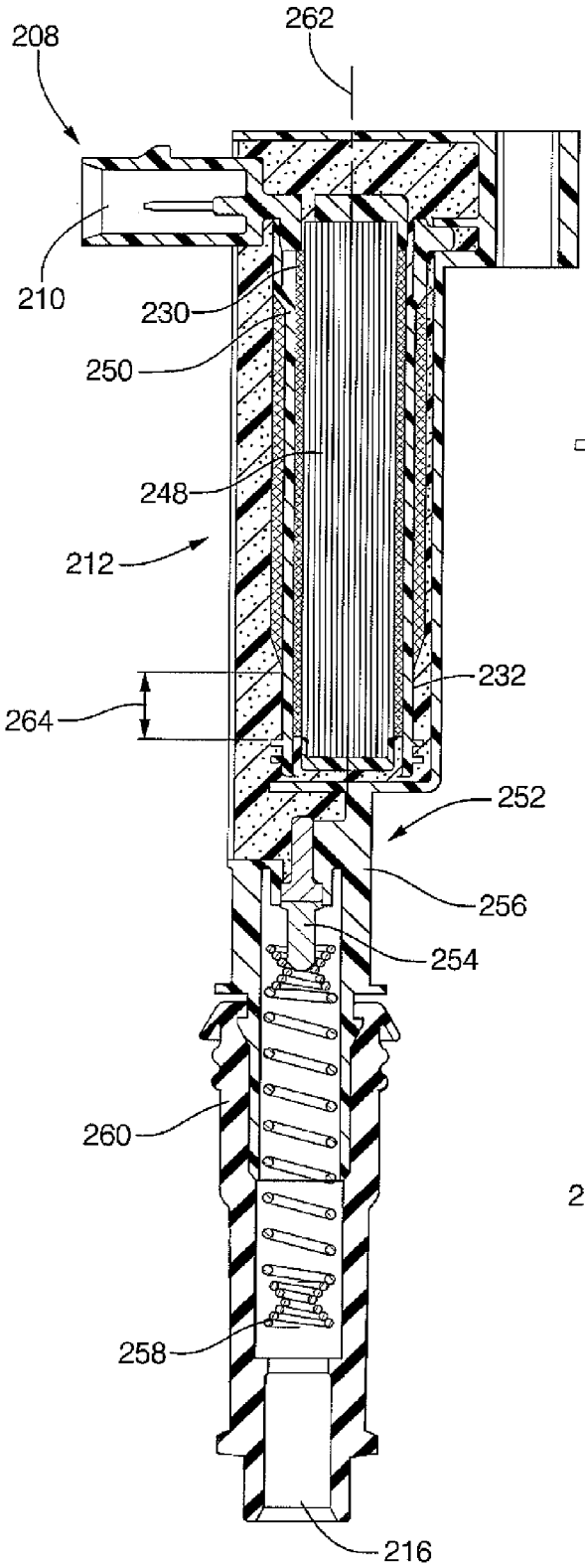
FIG. 13 is a cross-sectional view of the ignition apparatus taken substantially along lines 13-13 in FIG. 10.

FIG. 13 is a cross-section view taken substantially along lines 13-13 in FIG. 10. Transformer assembly 212 includes a central core 248, primary and secondary windings 230, 232, and an outer core or shield. Central core 248 is elongated and has a main axis 262. The primary and secondary windings 230, 232 are both illustrated as being disposed radially outwardly of central core 248.

With continued reference to FIG. 13, ignition apparatus 208 further includes a secondary winding spool 250 configured to receive and retain secondary winding 232, for example, wound in a progressive winding pattern. FIG. 13 further shows first HV connection 216 established through a first high-voltage (HV) tower 252 comprising a first HV terminal 254, a first HV housing 256, a first HV connector assembly 258 (e.g., a spring assembly or the like) and a spark plug boot 260. The second HV connection 224 is likewise established through a second HV tower comprising a second HV terminal, a second HV housing, and a second HV connector assembly (see FIG. 10).

As described above, preferred embodiments of the present invention define capacitance balancing structures by adjusting (increasing) the capacitance at the first HV connection (i.e., direct mount plug end). Several embodiments will now be described.

Figure 14:
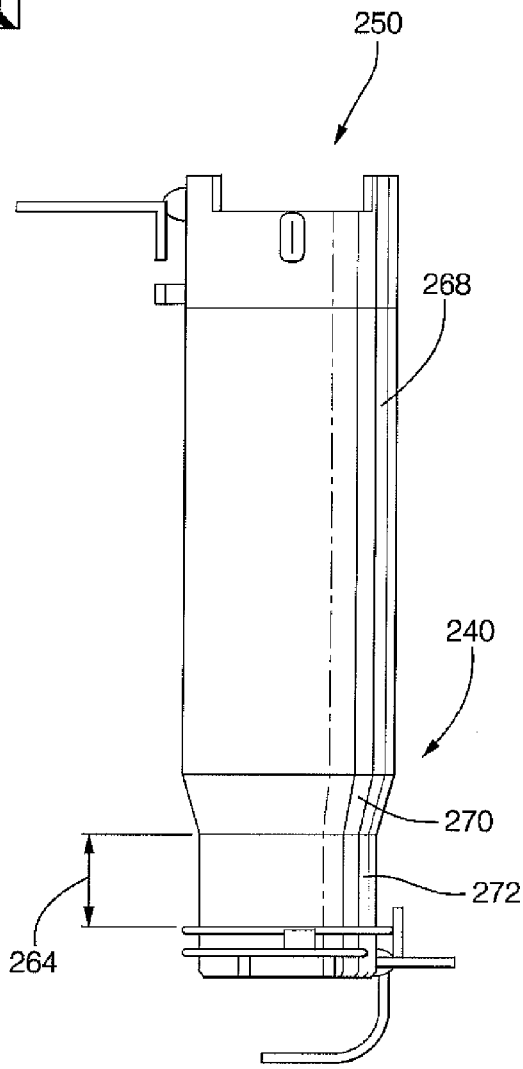
FIG. 14 is a side view of a secondary winding spool having a single-layer secondary winding section according to a first embodiment.

The first embodiment is shown in FIGS. 13 and 14 and involve having a single layer of secondary winding extend over the primary winding at the direct mount plug end of the ignition apparatus. Since there is very little voltage induced in the single layer it is all nearly at the highest voltage and the capacitance per axial length of secondary winding is a multiple (e.g., 3×) of that in the winding bay. Selecting a length can be thus be used to add a desired amount of capacitance to the first HV connection (direct mount plug end).

As shown in FIG. 14, secondary winding spool 250 has a winding surface that includes a main section 268, a tapered section 270 axially adjacent the main section 268, and a single-layer section 272 that is axially adjacent the tapered section 270. The surface of tapered section 270 forms a predetermined angle, which may be approximately 15 degrees (+/−5 degrees), with the surface of the single-layer section 272. The single-layer section 272 is formed having a predetermined axial extent 264 (i.e., axial length).

Referring now to FIGS. 13 and 14, capacitance balancing structure 240 thus comprises a secondary spool 250 with a winding surface having a single-layer section 272 located near the axial end 218 of the apparatus (direct mount plug end) where the secondary winding 232 is disposed in a single layer. As more particularly shown in FIG. 13, the single-layer section 272 has an axial extent 264 selected to increase the capacitance such that the first and second capacitances are balanced within a predetermined range, for example in accordance with the criteria described above (e.g., to obtain substantially equal HV output voltages). More specifically, the secondary spool 250 includes a spool axis that is substantially coaxial with the main axis 262 of the central core 248. The predetermined axial extent 264 of the single-layer section 272 of the secondary winding 232 substantially overlaps the primary winding 230. Through the foregoing, the capacitance contribution due to the secondary winding can be increased with respect to the first HV connection on the direct mount plug end 218, all in order to balance the total first and second capacitance values 236 and 238.

Figure 15:
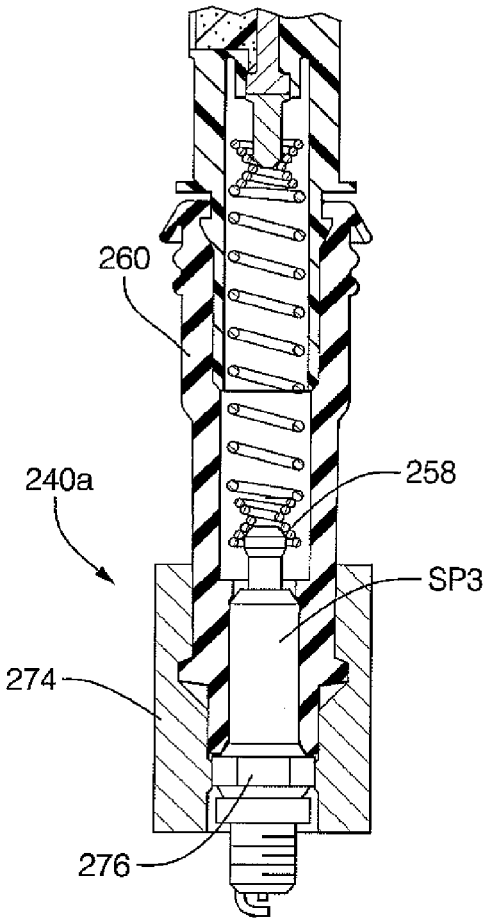
FIG. 15 is a partial cross-section view of a second embodiment including an electrically-conductive shell surrounding a spark plug boot.

FIG. 15 shows a second embodiment of the present invention, which includes an alternative capacitance balancing structure designated 240*a*. Capacitance balancing structure 240*a* comprises a modified boot 260' that includes a shell 274 of electrically conductive material around the spark plug boot 260' that contacts a base portion 276 of the spark plug. As shown, the boot 260' surrounds a portion of the HV tower housing 256 and comprises electrical insulating material, as is conventional. Note, the shell 274 has been exaggerated in size to increase its clarity in the figure. The contact with the base in effect electrically grounds the conductive shell, which will serve to add capacitance at the desired HV connection of the ignition apparatus 208. This embodiment has particular utility since it can be added to an ignition coil design even after such design is completed to "fix" or tune performance by balancing capacitance, as described above.

Figure 16:
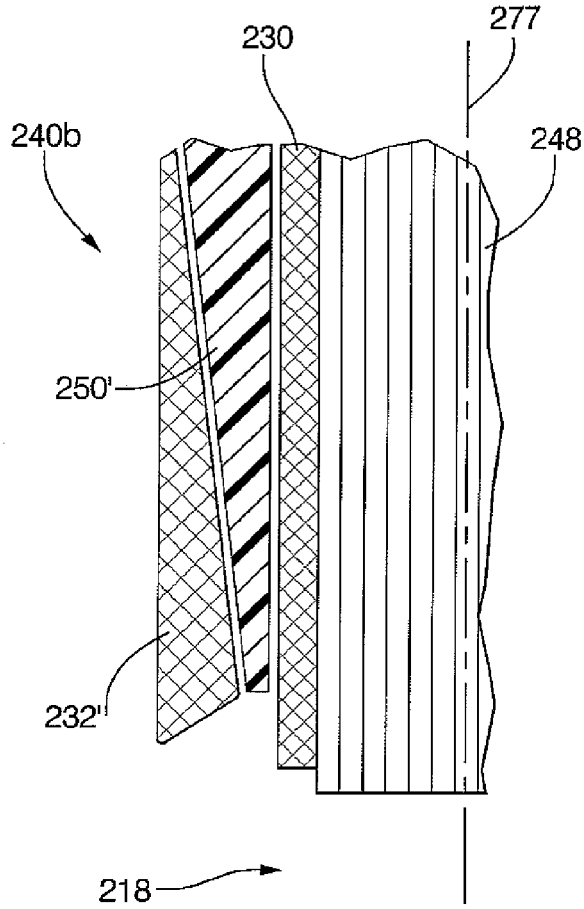
FIG. 16 is a partial cross-section view of a third embodiment including a reverse taper secondary winding spool.

FIG. 16 shows a third embodiment of the present invention, which includes an alternative capacitance balancing structure designated 240*b*. A modified secondary winding spool, designated 250', includes a generally cylindrical body and extends along a spool axis 277. The modified spool 250' includes a winding surface configured to receive and retain the secondary winding wound for example, in a progressive winding pattern. In this embodiment 240*b*, the central core 248, the primary winding 230, and the spool 250' are coaxially arranged where the primary winding 230 is disposed radially outwardly of the central core 248 and the secondary spool 250' is disposed radially outwardly of the primary winding 230.

The capacitance balancing structure 240*b* comprises an axially-extending taper of the cylindrical body portion of the modified spool 250' such that a secondary winding-to-primary winding distance (measured radially) decreases as the axial distance from end 218 decreases. The resulting secondary winding is designated 232', and results in an increase in the capacitance at the first HV connection 216 at end 218 (direct mount plug end). Note, this is the reverse of conventional arrangements, where a taper in the secondary spool is opposite so that the radial secondary-to-primary winding distance is increased as you approach the HV end of the secondary winding.

Figure 17:
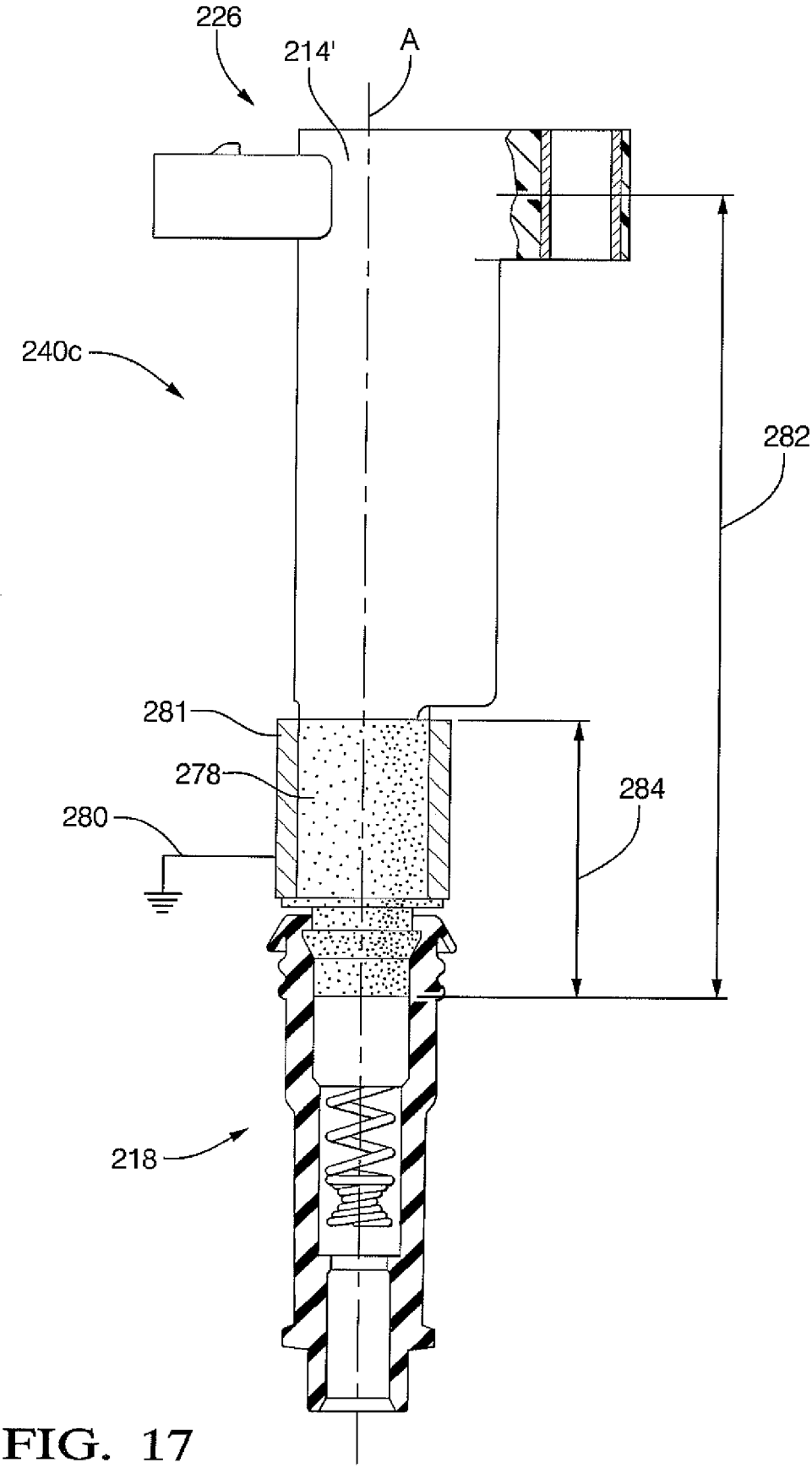
FIG. 17 is a partial cross-section view of a fourth embodiment including an electrically conductive coating on an outer surface of the case.

FIG. 17 shows a fourth embodiment of the present invention, which includes a still further alternative capacitance balancing structure designated 240*c*. In this embodiment, the case is modified to include an electrically conductive coating over a lowermost portion of the case, which coating is then grounded. The modified case is designated 214'.

The modified case 214' includes a body portion coaxially extending and surrounding the transformer assembly 212. As illustrated, the capacitance balancing structure 240*c* comprises an electrically conductive coating 278 that is disposed over a radially outermost surface of the body portion of the modified case 214'. The electrically conductive coating 278 is preferably substantially continuous over a predetermined axial extent near the plug end 218. As shown, the coating 278 is electrically coupled to ground by way of a grounding connection 280. In one embodiment, the axial extent of the conductive coating 278 corresponds approximately to the axially lowermost half of the case 214' (near the first, bottom axial end 218). For frame of reference, one may define as a starting point the axial length of central core, illustratively shown as axial length 282. Accordingly, the axial extent 284 of the continuous coating 278 may be selected to be no greater than one-half of the total axial length 282. Moreover, the ground connection 280 may be achieved by contacting the conductive coating 278 to an outer core or shield 281, which is itself electrically conductive and grounded.

In construction, the conductive coating 278 may comprise a base material and an additive material wherein the additive material is an electrically conductive material. For example, the base material may be selected from the group of polymeric materials consisting essentially of paint, epoxy, polyester and polyurethane. The additive material may be a conductive or semi-conductive material selected from the group consisting of carbon black, silver, aluminum and iron. Preferably, the additive material comprises carbon black. Alternatively, the conductive coating 278 may be formed by way of electroplating. These and other approaches for forming an electrically conductive or semiconductive coating 278 known in the art fall within the spirit and scope of the present invention, as seen for example in U.S. Pat. No. 6,556,116 entitled "EROSION RESISTANT PENCIL COIL HAVING EXTERNAL SECONDARY WINDING AND SHIELD" issued to Skinner et al., the entire disclosure of which is hereby incorporated by reference. The capacitance provided by conductive coating 278 is thus additive to the first HV connection 218, which is operative to balance the capacitance and offset that contributed by the HV cable 228.

Figure 18:
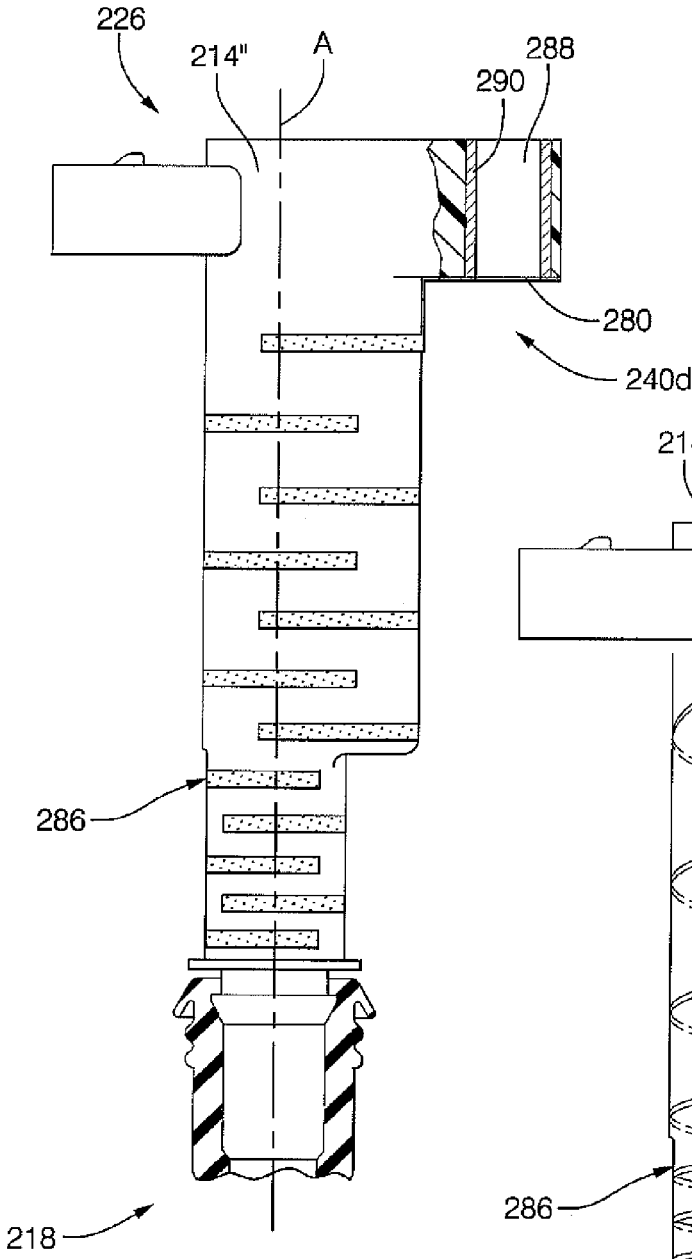
FIG. 18 is a partial cross-section view of a fifth embodiment including a series of electrically conductive traces on an outermost surface of the case.

FIG. 18 shows a fifth embodiment of the present invention, which includes a still further alternative capacitance balancing structure designated 240*d*. FIG. 18 shows a modified case 214" that includes a main body portion comprising electrical insulating material and which is coaxially extending and surrounding the transformer assembly 212. The modified case 214" also includes a mounting bore 288 which includes an electrically conductive mounting bushing 290. As known, the mounting bore 288 may be used with a conventional fastener to mount the ignition coil to the engine.

The balancing structure 240*d* includes a series of electrically conductive traces 286 that are applied or are otherwise disposed on a radially outermost surface of the case, and are formed using either conductive ink or a conductive (or semi-conductive) coating (as described above). The conductive traces are electrically connected to the grounded mounting bushing 290. The conductive traces 286 are arranged to cover an increasing percentage of the available outermost surface area of the case as the distance from the grounded bushing increases and as the distance left to the axial end 218 (plug end) decreases. The function describing the rate at which the percentage increases, is defined such that the first capacitance and the second capacitance are balanced within a predetermined range (as described above). This approach effectively increases the capacitance attributable to the secondary winding that is observed at the first HV connection 216 (direct mount plug end).

Figure 19:
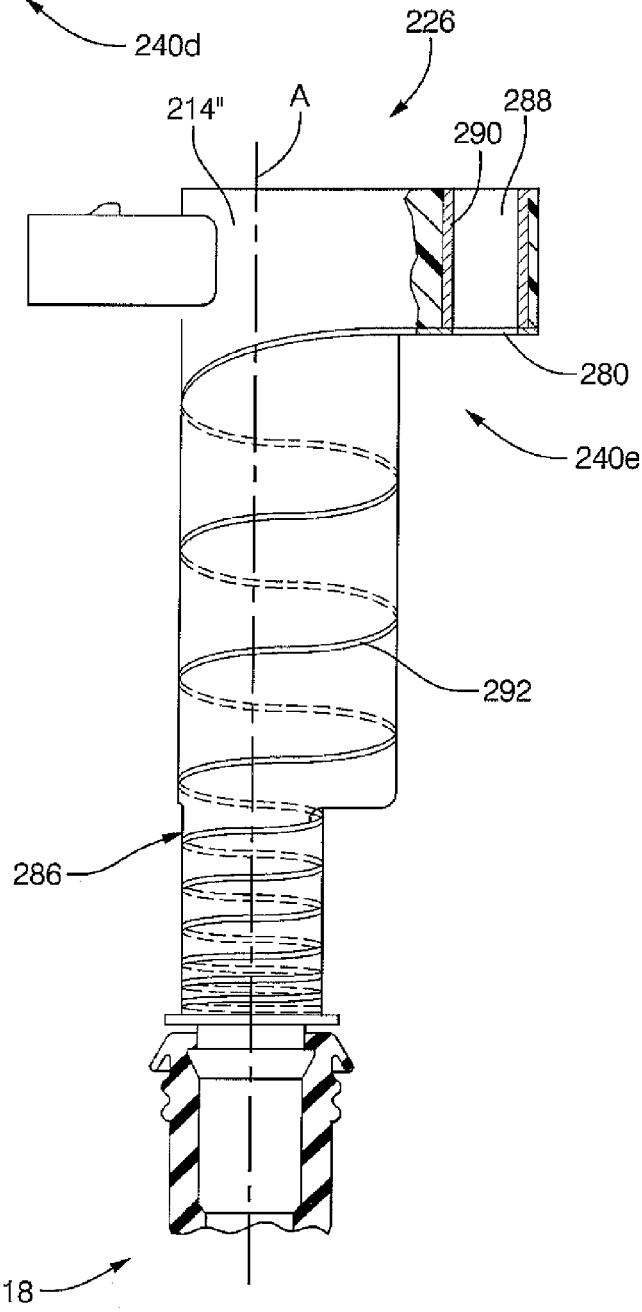
FIG. 19 is a partial side view of a sixth embodiment including an electrically conductive trace in the form of a continuous spiral on an outermost surface of the case.

FIG. 19 shows a sixth embodiment of the present invention, which includes an alternative capacitance balancing structure designated 240*e*. FIG. 18 shows a modified case 214'" that includes a main body portion comprising electrical insulating material and which is coaxially extending and surrounding the transformer assembly 212. The modified case 214'" also includes a mounting bore 288 which includes an electrically conductive mounting bushing 290 (and grounded to the engine when installed). The balancing structure 240*e* includes an electrically conductive trace 292 in the form of a continuous spiral disposed over a radially outermost surface of the case. The spiral trace 292 extends from the grounded mounting bushing 290 toward the first lower end 218 of the case 214'". The spiral trace 292 has an increasing number of turns per unit axial length (taken with respect to axis "A") as the axial distance from the grounded bushing 290 increases and as the axial distance to the first end 218 decreases. The rate of increase of the number of turns per unit axial length is selected such that the first capacitance 236 and the second capacitance 238 are balanced within a predetermined range. In other words, the spiral trace 292 starts at the grounded mounting bushing and then progresses down the case. The spiral trace 292, as shown, is relatively "loose" at the top end of the case to add relatively little capacitance to the HV cable end of the ignition apparatus (i.e., as seen from the second HV connection 224). The "tightness" of the spiral trace 292 would increase toward the direct mount plug end to add an increasing amount of capacitance. This embodiment has particular utility in "tuning" the capacitance characteristics to balance the first and second capacitances (as described above) to within a predetermined range without having to alter or otherwise change the underlying transformer assembly 212.

FIGS. 20-26 depict an additional embodiment of the present invention. As with the embodiment of FIGS. 10-19, this embodiment implements the desired ignition coil configuration for a two plug system, namely, that of the non center-tapped secondary winding that provides one positive and one negative spark voltage. To the extent that the capacitive load is balanced with respect to the two HV outputs, then each such HV output receives equivalent available voltage. One challenge arises, however, if one HV output has a lower (or greater) load capacitance. This imbalance may exist, for example, due to the fact that such a twin spark ignition coil is directly mounted to a first spark plug but is connected to a second spark plug by an HV connection mechanism, such as an HV cable, which inserts its own load capacitance. This imbalance not only increases the output HV voltage (i.e., measured in kV) to the lower capacitance HV connection but it also decreases the voltage output to the HV connection with the higher capacitance. While the embodiment of FIGS. 10-19 achieves balance by adding capacitance to the direct-mount end of the ignition coil (i.e., the side of the secondary winding having the lower capacitance to begin with), the embodiment of FIGS. 20-26 achieves balance by reducing the internal load capacitance on the end of the ignition apparatus that will see the additional HV cable capacitance. The embodiment of FIGS. 20-26 has the advantage of providing balanced load capacitance at a reduced cost relative to the embodiment of FIGS. 10-19. Additionally, the embodiment of FIGS. 20-26 present a decreased total load on the ignition apparatus and therefore less input energy is required in order to meet desired high voltage output levels (e.g., kV).

This embodiment provides a transformer design with an axial offset in the physical placement between the primary and secondary windings that is configured to balance an otherwise imbalanced load capacitance. As described above, if one HV end of the ignition apparatus is mounted directly to a spark plug, then the load capacitance may be between about 15 to 25 pF. If the other HV end is connected to a second spark plug via an HV cable, then the load capacitance seen at this other end may be between about 25 and 50 pF. The embodiment of FIGS. 20-26 achieves balance by effectively "removing" or shifting capacitance away from the end that will see the additional capacitive load and to the other end that will see the lower capacitive load.

The transformer design described above where the physical location of the secondary winding is axially offset from the physical location of the primary winding is done so as to alter the secondary winding/primary winding coupling, all as a function of the axial length of the secondary winding. This approach, as described in greater detail below, alters the capacitance profile of the secondary winding.

Figure 20:
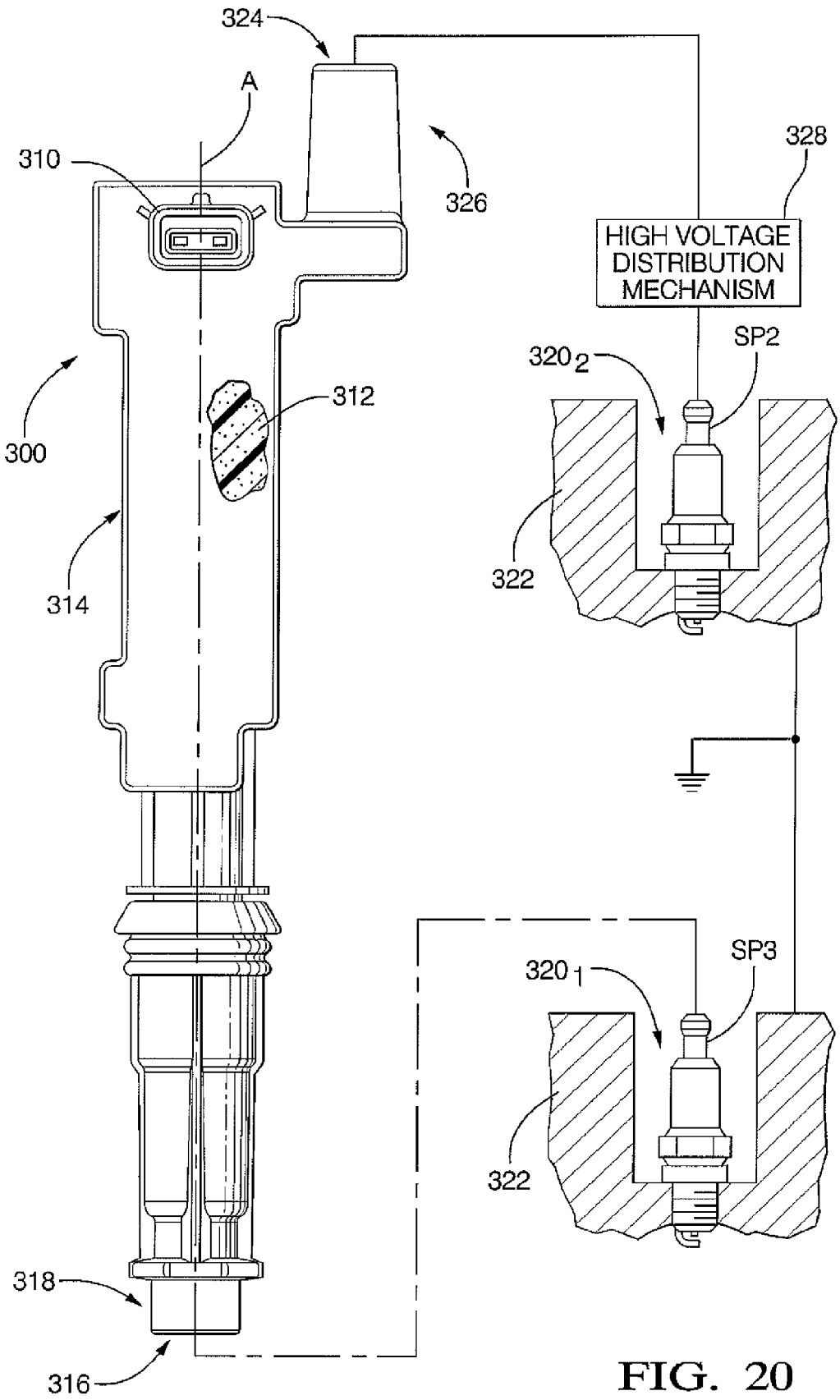
FIG. 20 is a side view of an ignition apparatus in accordance with another embodiment employing a shifted secondary winding to balance load capacitance.

FIG. 20 illustrates an ignition apparatus 300 according to this aspect of the invention. The description above of embodiments 10, 208 apply equally to apparatus 300, except as to any differences to be described below. Ignition apparatus 300 is configured to be controlled by a control signal (e.g., an electronic spark timing (EST) signal) received through a low voltage (LV) connector assembly 310. Ignition apparatus 300 includes a pencil coil transformer assembly 312 and a case 314.

Case 314 extends along a main axis designated "A" in FIG. 20, and is configured to house transformer assembly 312. Case 314 includes a first high-voltage (HV) connection 316 proximate or near a first longitudinal end 318. First HV connection 316 is configured for direct mounting on a first spark plug, which is designated SP3 in FIG. 20. First spark plug SP3 may be disposed in a first spark plug well $\mathbf{320}_1$ formed in an internal combustion engine 322. The first HV connection 316 has a first capacitance $C_1$ associated therewith when directly mounted to the first spark plug ("SP3").

Case 314 further includes a second high-voltage (HV) connection 324 proximate a second longitudinal end 326. Second end 326 is axially opposite first end 318 in the illustrative embodiment. Second HV connection 324 is configured for connection to a second spark plug (designated SP2 in FIG. 10) via a high-voltage (HV) distribution mechanism 328. Second spark plug SP2 may be disposed in a second spark plug well $\mathbf{320}_2$ formed in internal combustion engine 322. The HV distribution mechanism 328 may be a conventional HV spark plug lead or cable 328. The second HV connection 324 has a second capacitance $C_2$ associated therewith when connected to the second spark plug.

Figure 21:
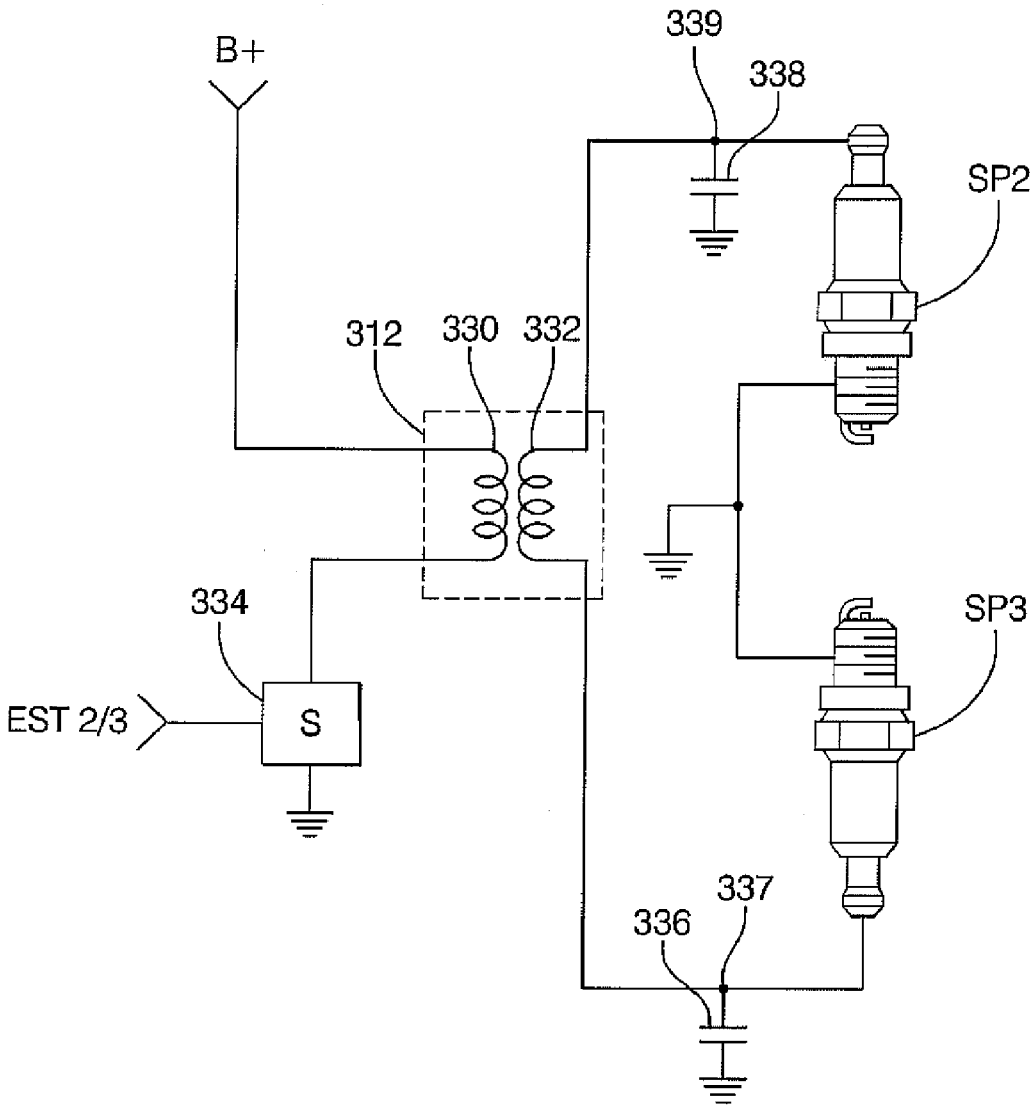
FIG. 21 is a schematic diagram corresponding to the embodiment of FIG. 20.

FIG. 21 is a schematic and block diagram of ignition apparatus 300. As illustrated, transformer assembly 312 includes a primary winding 330 and a secondary winding 332. A charging current is controlled by a switch 334 in accordance with an electronic timing signal (EST 2/3), all as described above in connection with apparatus 10 and FIG. 2. The first HV connection 316 is directly mounted to the first spark plug SP3 and has a capacitance 336 associated therewith taken at node 337 (i.e., corresponding to the first capacitance $C_1$ described above). The second HV connection 324 is connected to the second spark plug SP2, and has a capacitance 338 associated therewith taken at node 339 (i.e., corresponding to the second capacitance $C_2$ described above). It should be understood that the second capacitance 338 ($C_2$) includes the capacitance introduced by the HV distribution mechanism 328 (i.e., the HV cable). Assuming conventional designs for the HV transformer, an imbalance with respect to load capacitance would be seen the by the HV transformer 312. However, the inventive feature of apparatus 300 provides an HV transformer design where, overall, the first and second capacitances 336, 338 are balanced to within a predetermined range. Accordingly, the output voltages at the respective spark plugs can be likewise controlled to within a specified range, and the optimal (maximum) amount of energy delivered for ignition.

Figure 22:
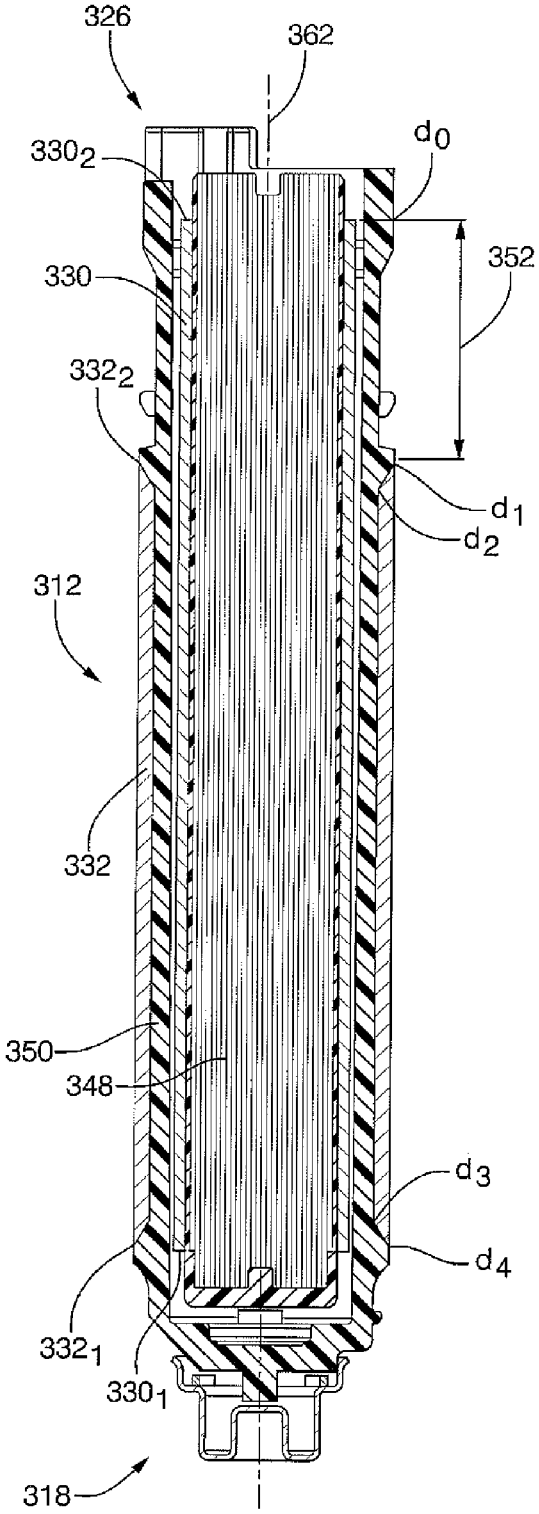
FIG. 22 is a cross-sectional view of a transformer assembly of the ignition apparatus in FIG. 20.

FIG. 22 is cross-sectional view of HV transformer assembly 312, which is generally elongated and disposed within case 314. First case end 318 and second, axially-opposite case end 326 are shown for reference. FIG. 22 additionally shows primary winding 330, secondary winding 332, a central core 348, and a secondary winding spool 350. Primary winding 330 extends between a first primary winding end $\mathbf{330}_1$ (bottom) and an axially opposite second primary winding end $\mathbf{330}_2$ (top). The first primary winding end $\mathbf{330}_1$ is located proximate or near the first case end 318. The secondary winding 332 extends between a first secondary winding end $\mathbf{332}_1$ (bottom) and an axially opposite second secondary winding end $\mathbf{332}_2$ (top). The first secondary winding end $\mathbf{332}_1$ is located proximate or near the first case end 318. FIG. 22 further shows a predetermined axial distance 352 (described in greater detail below), and a series of reference points designated $d_0$, $d_1$, $d_2$, $d_3$ and $d_4$ that correspond to a distance from the start of the primary winding 330.

Figure 23:
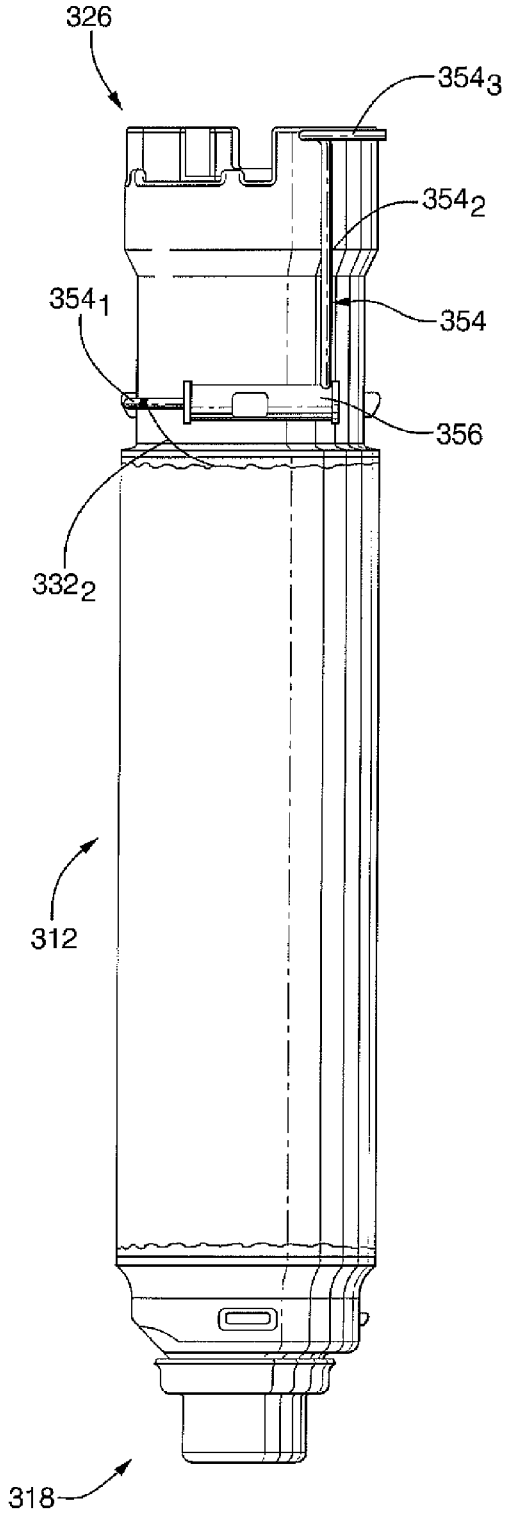
FIG. 23 is a side view of the transformer assembly of FIG. 22 illustrating a stiff wire connector to preserve load capacitance balance.

FIG. 23 is a side view of transformer assembly 312, again shown with first case end 318 and second case end 326 for reference. FIG. 23 shows a connector 354 configured to connect the second secondary winding end $\mathbf{332}_2$ (top) to the second HV connection 324. FIG. 23 also shows a boss (356) formed of electrical insulating material configured to engage and position connector 354 within case 314.

Figure 24:
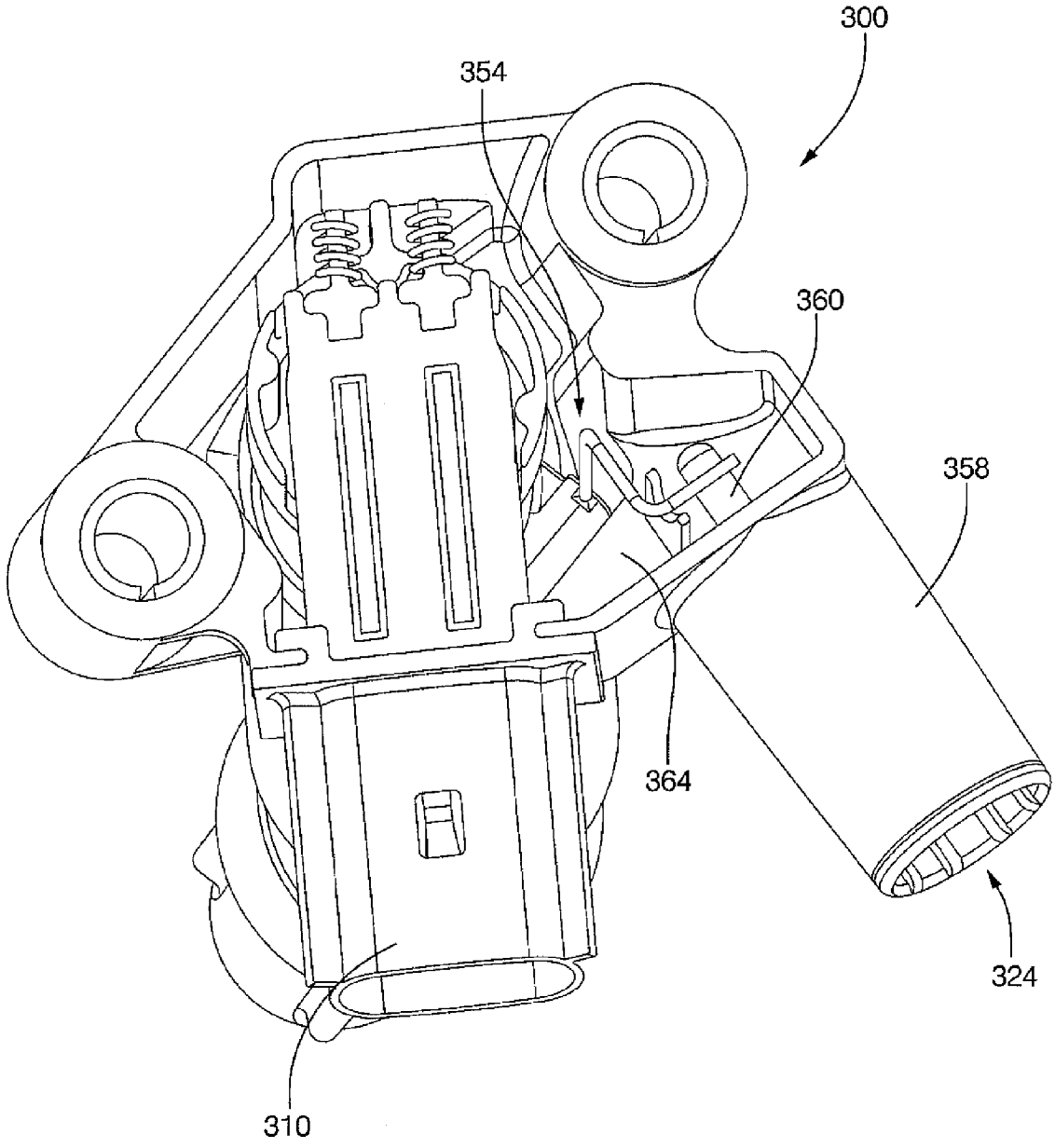
FIG. 24 is a top view of the ignition apparatus of FIG. 20.

FIG. 24 is a top view of ignition apparatus 300. Second HV connection 324 includes a high-voltage tower housing 358 and a high-voltage terminal 360. Connector 354 is electrically connected to HV terminal 360, for example only, by a weld or other conventional connection mechanism known to one of ordinary skill in the art. This connection is made in an enlarged well 364 formed in case 314, and which forms a node 365.

Figure 25:
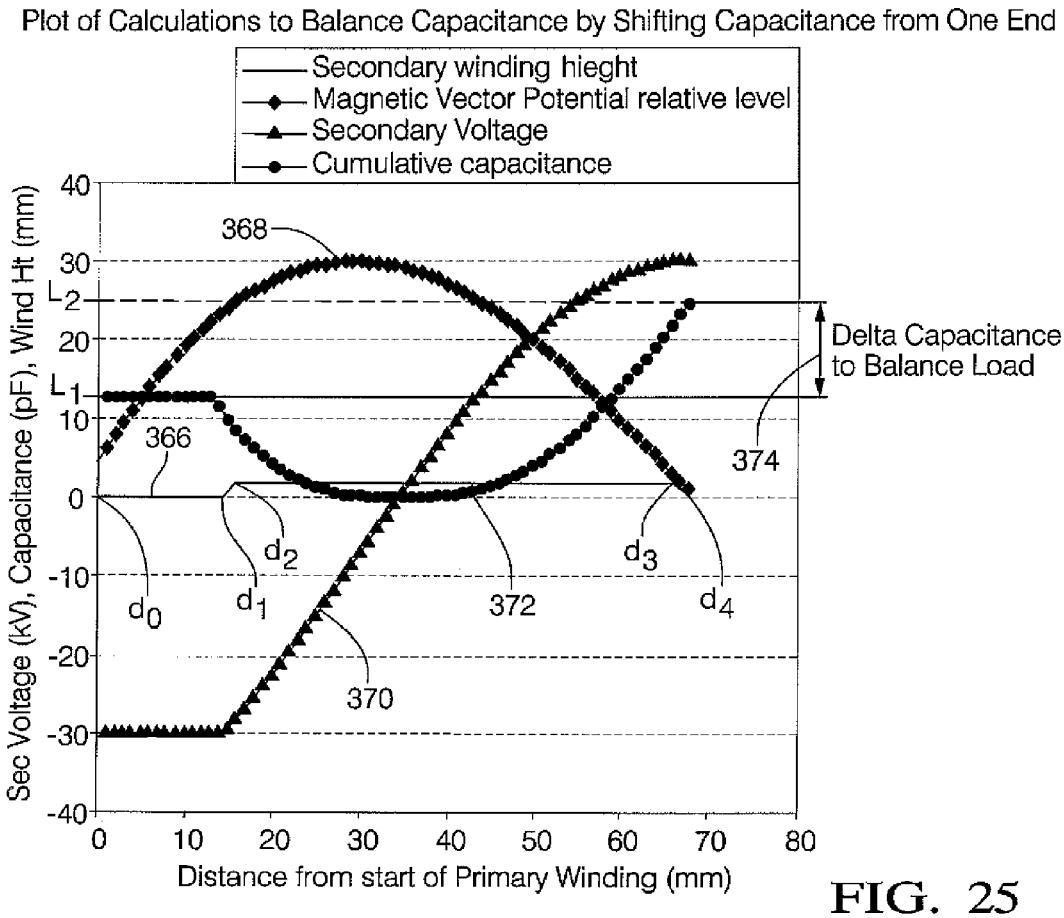
FIG. 25 is a combination diagram plotting a number of electrical characteristics of the ignition apparatus of FIG. 20 versus a secondary winding shift distance.

FIG. 25 is a combination diagram plotting a number of electrical characteristics of ignition apparatus 300, showing the results for a shifted secondary winding (relative to the primary winding). The various characteristics to be described, and that are plotted, include a secondary winding height, designated trace 366, a magnetic vector potential, designated trace 368, a secondary winding voltage, designated as trace 370 and a cumulative capacitance, designated as trace 372. The voltage induced on the secondary winding is proportional to a magnetic vector potential evaluated axially along the secondary winding. The voltage can be calculated by taking the integral of the turns per mm of secondary winding, which is proportional to the winding height and the magnetic vector potential. In certain embodiments, the induced voltage may be determined for proposed designs using finite element analysis (FEA). The secondary winding may be shifted relative to the primary winding to change the voltage distribution and therefore the energy stored in the electric field from the secondary winding to the various ground or near-ground planes (e.g., primary winding, central core, external engine components and the like are at ground or near-ground). The capacitance from the secondary winding to these various ground and near-ground planes is governed by the following equation (5):

$$C = \frac{2 * E}{V^2} \tag{5}$$

Where C=capacitance,

E=stored energy in the electric field, and

V=secondary output voltage.

With continued reference now to both FIGS. 22 and 25, in accordance with this aspect of the invention, secondary winding 332 is axially offset by a predetermined distance 352 in a direction towards the first case end 318 (i.e., in a direction towards the first HV connection 316, shown best in FIG. 20). The series of reference points designated $d_0$, $d_1$, $d_2$, $d_3$ and $d_4$ are illustrated in both FIG. 20 and FIG. 25 and thus may be used to correlate the two. As shown, the respective voltage outputs on each of the ends of the secondary winding are approximately ±30 kV. At end 326 (i.e., the top of FIG. 22), which corresponds to the end that is connected to spark plug SP2 via an HV cable 328, the capacitance is at a level designated as $L_1$ pF. At the axially opposite end 318 (i.e., the bottom of FIG. 22), which corresponds to the end that will be direct mount connected to spark plug SP3, the capacitance is at a level designated $L_2$ pF. The difference between $L_1$ and $L_2$ is shown in FIG. 25 as a delta capacitance 374. The predetermined distance 352 in which the secondary winding 332 is offset from the primary winding, and which corresponds to the delta capacitance 374 produced thereby, is selected such that the first capacitance 336 (direct mount end) and the second capacitance 338 (HV cable end) are balanced to within a predetermined range. In this embodiment, the voltage at the second HV connection 324 (i.e., cable 328) intersects that of the first HV connection 316 at approximately 34 pF (i.e., when the capacitance of the direct-mount plug end and that of the lead end, which also includes the capacitance of the cable, are approximately 34 pF). In this embodiment, to maintain both of the HV output voltages to within a predetermined range of +/−1 kV, the capacitance should be balanced to within the predetermined range, for between about −6.7 pF to +2.5 pF, taken with respect to a 34 pF capacitance. The balance point of this embodiment therefore is shifted towards the capacitance level of the plug end, and lower energy is required for lower total capacitance expands the range, relative to the embodiments of FIGS. 10-19.

The delta capacitance 374 (and hence the predetermined offset distance 352) will in most instances be selected to correspond to the expected capacitance of the HV cable 328 that is contemplated for use during the service life of ignition apparatus 300. The predetermined offset 352 may be determined through FEA (described above) in order to achieve desired capacitance balancing. In one embodiment, the predetermined offset distance 352 was approximately 15 mm. It should be further understood that the shape of the secondary winding 332 (viz. the winding height relative to the winding axis) may also be modified in accordance with the principles described above to effect a desired shift of capacitance to thereby create a delta capacitance 374. In a still further embodiment, an axial offset of the secondary winding relative to the primary winding, in combination with various secondary winding shapes/height profiles, may be employed, and remain within the spirit and scope of the present invention.

Figure 26:
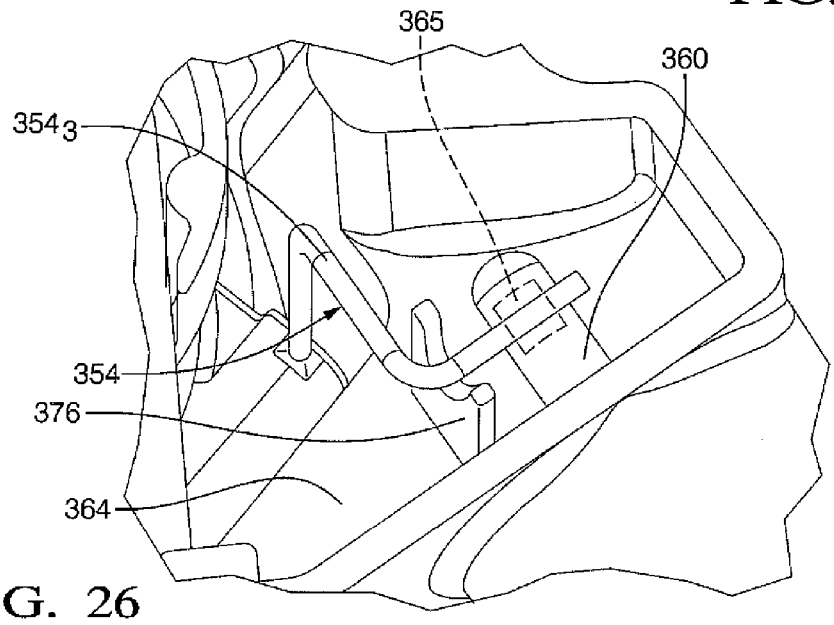
FIG. 26 is an enlarged view of FIG. 24.

Referring now to FIGS. 23-24 and 26, another inventive aspect of apparatus 300 pertains to the configuration and positioning of electrical connector 354. One known approach for connecting the high voltage produced at the end of the secondary winding involves the following: (i) spiraling the secondary winding down into a single layer to the "top" of the ignition coil; (ii) terminating the HV end of the secondary winding to a metal HV post, for example, that is molded into the spool; and (iii) electrically connecting the HV post to the HV terminal on the HV tower. However, this approach would result in adding back more capacitance to that end than was shifted away by virtue of the offset secondary winding design described above. This would be the result because of the fact that the single layer is all at the spark voltage and hence would store an increased amount of energy (i.e., thereby also present a greater load capacitance). Additionally, the known HV post approach also brings the high voltage (spark voltage) near to various ground or near-ground planes, such as the primary winding, etc. also increasing capacitance This known approach would therefore somewhat counteract the benefits of this embodiment. Accordingly, this aspect minimizes "last mile" capacitance by providing a connector 354 that is configured to make a direct electrical connection between the high voltage end $\mathbf{332}_2$ of the secondary winding and the HV terminal 360.

With specific reference now to FIG. 23, connector 354 is a relatively stiff wire formed of electrically conductive material, preferably metal. In one embodiment, connector 354 is formed of wire having a diameter of approximately 1 mm. Connector 354 includes (i) a proximal portion $\mathbf{354}_1$ to which the secondary winding end $\mathbf{332}_2$ is terminated, (ii) an intermediate, axially-extending portion $\mathbf{354}_2$, and (iii) a distal portion $\mathbf{354}_3$ that is electrically connected to HV terminal 360.

FIG. 23 also shows boss 356, which comprises electrically-insulating material (e.g., plastic) and is configured to engage and position connector 354 in a predetermined orientation relative to the other components of ignition apparatus 300. The predetermined orientation is preferably configured to provide a maximal distance/space between the connector 354 itself and any ground or near-ground planes. Additionally, boss 360 is operative to orient the axially-extending portion $\mathbf{354}_2$ of connector 354 so that it is substantially parallel to axis 362. This relationship is effective at reducing the amount of electric field coupling between the connector 354 and any ground or near ground planes, thereby reducing capacitance.

FIG. 26 is an enlarged view of FIG. 24. Portion $\mathbf{354}_3$ of connector 354 is coupled to HV terminal 360 (e.g., via weld) to form a node 365 (shown in dashed-line box). Case 314 is also configured to include well 364 in which the connection at node 366 can be disposed with a maximum amount of space therearound, again to reduce capacitance. FIG. 26 also shows a fork support 376, configured to receive connector 354 (specifically, portion $\mathbf{354}_3$), and, in cooperation with boss 356, more reliably position connector 354 in the predetermined orientation described above.

While particular embodiments of the invention have been shown and described, numerous variations and alternate embodiments will occur to those skilled in the art. Accordingly, it is intended that the invention be limited only in terms of the appended claims.

The invention claimed is:

1. An ignition apparatus comprising:

a transformer assembly including a central core, a primary and a secondary winding, and an outer core, said central core being elongated and having a main axis, said primary and secondary windings being radially outwardly of said central core;

a case configured to house said transformer assembly, said case including a first high-voltage (HV) connection at a first end thereof configured for direct mounting on a first spark plug, said first HV connection having a first capacitance associated therewith when direct mounted to said first spark plug, said case further including a second HV connection at a second end thereof opposite said first end configured for connection to a second spark plug via a high-voltage distribution mechanism, said second HV connection having a second capacitance associated therewith when coupled to said second spark plug;

said secondary winding being offset by a predetermined distance from said primary winding in a direction towards said first case end, said predetermined distance being selected such that said first capacitance and said second capacitance are balanced within a predetermined range.

2. The apparatus of claim 1 wherein said primary winding extends between a first primary winding end and an axially opposite second primary winding end, said first primary winding end being proximate said first case end, said secondary winding extending between a first secondary winding end and an axially opposite second secondary winding end, said first secondary winding end being proximate said first case end, said second secondary winding end being offset by said predetermined distance from said second primary winding end in said direction towards said first case end, said first primary winding end and said first secondary winding end being axially aligned.

3. The apparatus of claim 1 wherein said predetermined distance is between about 1 mm and 20 mm, preferably between about 10 mm and 20 mm, more preferably between about 15 mm and 20 mm, and may be about 15 mm.

4. The apparatus of claim 1 wherein said second HV connection comprises a high-voltage (HV) tower having a high-voltage (HV) terminal, said apparatus further including a connector configured to electrically connect said second secondary winding end to said high-voltage (HV) terminal.

5. The apparatus of claim 4 wherein said case includes a boss feature configured to engage said connector.

6. The apparatus of claim 4 wherein said connector includes an axially-extending portion that is substantially parallel to said main axis.

7. The apparatus of claim 6 wherein said axially-extending portion is positioned substantially intermediate said primary winding and said case.

8. The apparatus of claim 6 wherein said connector includes a distal portion connected to said HV terminal at a node, said case being configured to include a well surrounding said node.

9. The apparatus of claim 6 wherein said connector comprises wire approximately 1 mm in diameter.

10. The apparatus of claim 1 wherein said predetermined range is between about −6.7 pF and +2.5 pF taken about 34 pF.

* * * * *